US006919686B2

(12) United States Patent
Okamoto et al.

(10) Patent No.: US 6,919,686 B2
(45) Date of Patent: Jul. 19, 2005

(54) DISCHARGE LAMP HAVING AN AUXILIARY LIGHT SOURCE TO PRODUCE LIGHT WITH A SHORT WAVELENGTH

(75) Inventors: Masashi Okamoto, Hyogo-ken (JP); Takashi Yamashita, Hyogo-ken (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 113 days.

(21) Appl. No.: 10/338,661

(22) Filed: Jan. 9, 2003

(65) Prior Publication Data

US 2003/0127985 A1 Jul. 10, 2003

(30) Foreign Application Priority Data

Jan. 9, 2002 (JP) ..... 2002-002317

(51) Int. Cl.[7] ..... H01J 7/30

(52) U.S. Cl. ..... 313/594; 313/601; 315/60

(58) Field of Search ..... 313/570, 634, 313/25, 594, 601, 602, 603, 607, 592, 637, 234; 315/330, 335, 336, 60, 73

(56) References Cited

U.S. PATENT DOCUMENTS

| | | | |
|---|---|---|---|
| 4,328,446 A | 5/1982 | Fallier, Jr. et al. | |
| 4,721,888 A | 1/1988 | Proud et al. | |
| 4,812,714 A | 3/1989 | Keeffe et al. | |
| 4,818,915 A | 4/1989 | Zaslavsky et al. | |
| 4,987,344 A | 1/1991 | Zaslavsky et al. | |
| 5,323,091 A | 6/1994 | Morris | |
| 5,550,421 A | 8/1996 | Scholz et al. | |
| 5,811,933 A | 9/1998 | Van Den Nieuwenhuizen et al. | |
| 5,959,404 A | 9/1999 | Nortrup et al. | |
| 5,990,599 A | 11/1999 | Jackson et al. | |
| 6,268,698 B1 | 7/2001 | Scholz | |
| 6,380,679 B1 * | 4/2002 | Leers et al. | 313/594 |
| 6,400,087 B2 * | 6/2002 | van den Nieuwenhuizen et al. | 315/73 |
| 2001/0017523 A1 | 8/2001 | Van Den Nieuwenhuizen et al. | |

FOREIGN PATENT DOCUMENTS

| | | |
|---|---|---|
| JP | 2-61957 A | 3/1990 |
| JP | 2-61958 A | 3/1990 |
| JP | 5-54983 A | 3/1993 |
| JP | 08-087984 | 4/1996 |
| JP | 09-097591 | 4/1997 |
| JP | 2002-100323 | 4/2002 |
| JP | 2002-151006 | 5/2002 |
| WO | WO 00/77826 A1 | 6/2000 |
| WO | WO 01/59811 A1 | 8/2001 |

OTHER PUBLICATIONS

Japanese Utility Midel SHO 37–8045 w/English Abstract.

* cited by examiner

*Primary Examiner*—Karabi Guharay
(74) *Attorney, Agent, or Firm*—Nixon Peabody LLP; David S. Safran

(57) ABSTRACT

The discharge lamp of the invention includes a main discharge vessel which is filled with a discharge medium for the main discharge via a pair of opposed main discharge electrodes, and has a first electrode sealing part and a second electrode sealing part for connecting the pair of main discharge electrodes. The advantage of the invention is in a starting electrode arranged such that it does not come into contact with the main discharge space, and an auxiliary light source which includes an auxiliary discharge vessel located adjacent on the side of one of the electrode sealing parts and which is not made integral with the electrode sealing parts. The auxiliary light source is filled with a discharge medium, and has a first outer electrode on the outside of the auxiliary discharge vessel.

8 Claims, 12 Drawing Sheets

DISCHARGE LAMP HAVING AN AUXILIARY LIGHT SOURCE TO PRODUCE LIGHT WITH A SHORT WAVELENGTH

BACKGROUND OF THE INVENTION

1. Field of the Invention

The invention relates to a discharge lamp with high radiance (HID lamp), such as a high pressure mercury discharge lamp, a metal halide lamp or the like, which is used for example as a light source for a projector.

2. Description of Related Art

In a light source device for an optical device such as a liquid crystal projector, a DLP projector or the like, a discharge lamp with high radiance, such as a high pressure mercury discharge lamp, a metal halide lamp, or the like is used. In these discharge lamps it is generally necessary when starting to apply a high voltage between the main discharge electrodes or between the electrode for the main discharge and the inside of the discharge vessel, to produce an insulation breakdown in the discharge medium within the discharge vessel, and to induce a glow discharge or an arc discharge, the electrons of the plasma which has been produced thereby acting as the triggering substance.

The voltage which is necessary for the insulation breakdown during starting is generally roughly a few kilovolts when the discharge lamp is in the temperature state of roughly room temperature. The voltage which is necessary for the insulation breakdown during starting however changes depending on the running time after turning off following completion of prior operation, i.e. depending on the temperature of the discharge space. It can be imagined that the reason for formation of one such change is the following:

According to the drop in the temperature of the discharge space after it is turned off, part of the vaporized discharge medium, such as mercury, halogen or the like, condenses. This gradually changes the composition of the gas portion of the discharge space. For this or similar reasons the voltage which is necessary for the insulation breakdown changes.

The voltage which is necessary for the insulation breakdown is very low for example in the case of a discharge lamp with a discharge medium which comprises halogens such as bromine and mercury and the like, and a rare gas such as argon or the like, and which contains for example greater than or equal to 0.15 mg mercury per cubic millimeter volume of the discharge space, because there is residual plasma immediately after turning off the discharge lamp. Afterwards it does rise quickly until however shortly afterwards it begins to drop again (under the condition of natural cooling without compressed air cooling of the discharge lamp) until it reaches the minimum value after roughly 30 seconds. The insulation breakdown voltage repeatedly rises and falls however afterwards in a complicated manner during the interval during which the temperature of the discharge space finally drops to roughly 100° C., i.e. for the duration of a few minutes after turning off.

In order to enable hot restart at a time as early as possible after turning off, the absolute value of the high voltage which can be applied during starting can easily be made high. But in this case the possibility of occurrence of the following disadvantages increases:

The high voltage which is to be applied causes the dangerous phenomenon of unintentional insulation breakdown, i.e. an insulation breakdown of the coating of an insulated cable, and a creep discharge on the connector, on the terminal or the like.

The noise when the high voltage is applied causes a malfunction of the electronic circuit of the device of the main projector part.

Therefore, conventional methods for enabling the starting of the discharge lamp without overly increasing the absolute value of the high voltage which is to be applied during starting, i.e. concepts for improving the starting property, have been developed. For example, U.S. Pat. No. 4,328,446, Japanese patent disclosure document HEI 2-61957, Japanese patent disclosure document HEI 2-61958, and the like have proposed a technique for improving the starting property of a discharge lamp, in which by placing a close-by conductor in the form of a wire or the like which is connected to the electrode of the main discharge, a high voltage is applied outside the main discharge vessel not only between the main discharge electrodes, but also between the inside of the main discharge vessel and the electrode for the main discharge.

Generally this is often called the outside trigger method which is used mainly for blinking lamps, in which without applying a high voltage between the main discharge electrodes a high voltage is applied to the conductor adjacent to the discharge vessel and in which thus a discharge is begun. In Japanese patent disclosure document HEI 5-54983 and Japanese utility model application SHO 37-8045, application of the outside trigger method for a discharge lamp with high radiance is proposed. The purpose here is, however, not to improve the starting property.

Since only action by a close-by conductor is of course not sufficient for improving the starting property, a proposal was made for reducing the absolute value of the high voltage which is to be applied during starting, in which light with a short wavelength such as UV radiation or the like is emitted and in which ionization of the discharge medium is promoted.

As the first conventional example, for example, U.S. Pat. No. 4,987,344 proposed a discharge lamp in which there is an auxiliary UV light source with an auxiliary discharge vessel which has a pair of inner electrodes. In U.S. Pat. No. 4,721,888 a discharge lamp is schematically shown in which in the vicinity of its hermetically sealed area there is an auxiliary UV light source with a pair of inner electrodes.

As the second conventional example, U.S. Pat. Nos. 5,550,421; 5,811,933; 4,818,915 (corresponding to JP HEI 1-134848); and U.S. Pat. No. 5,990,599 (corresponding to JP 2001-512622 A) and the like have proposed a discharge lamp in which there is an auxiliary UV light source in which in an auxiliary discharge vessel which is provided with an inner electrode a high voltage is subject to electrostatic capacitance coupling.

As the third conventional example, U.S. Pat. No. 4,812,714 (corresponding to JP HEI 1-134849) have proposed a discharge lamp in which there is an auxiliary UV light source in which in an auxiliary discharge vessel without an inner electrode a high voltage is subjected to electrostatic capacitance coupling.

As the fourth conventional example, U.S. Pat. No. 5,323,091 and International Patent Application publication WO-A-00/77826 proposed arranging a bubble-like secondary discharge chamber such that it is in contact with the conductive foil of the hermetically sealed area of the discharge lamp and which then operated as an auxiliary UV light source.

As the fifth conventional example, U.S. Pat. No. 5,959,404 (corresponding to JP HEI 8-236080) proposed a discharge lamp in which an auxiliary UV light source is formed integrally with the outside of its hermetically sealed area.

As the sixth conventional example, U.S. Pat. No. 6,268,698 (corresponding to JP 2000-173549 A) proposed a discharge lamp in which an auxiliary UV light source is formed integrally with the end face of its hermetically sealed area and carries out the discharge in the open space.

As the seventh conventional example, International Patent Application publications WO-A-99/48133 and WO-A-01/59811 proposed a discharge lamp in which there is an auxiliary discharge vessel with or without an inner electrode adjacent to the main discharge space, in which a high voltage is subjected to electrostatic capacitance coupling, and which is thus operated as an auxiliary UV light source, and in which moreover using the conductivity which is induced by the discharge in the auxiliary discharge vessel a high electrical field is applied to the main discharge space.

However, none of these conventional examples were satisfactory. In the case of the first and the second conventional examples, for example, there are the disadvantages that a hermetically sealed arrangement for enclosing the inner electrodes from the outside is necessary since the auxiliary discharge vessel has inner electrodes and that the production of the hermetically sealed arrangement is time-consuming and costly.

In the case of the third conventional example, there is the disadvantage that the arrangement of the discharge lamp is complicated, that its installation takes a large amount of time, that the arrangement must be protected by an outside vessel and that as a result costs are high even if the production of the auxiliary discharge vessel in itself need not take much time since a hermetically sealed arrangement is not necessary because the auxiliary discharge vessel does not have an inner electrode.

In the case of the fourth example, an extra component is not necessary, therefore no additional material costs accrue. But since the bubble-like secondary discharge chamber must be installed in the discharge lamp itself, there are the disadvantages that production takes much time, that a highly developed production technology is necessary, because in addition a hermetically sealed area is needed, that the probability that the discharge lamp itself is free of faults is certainly reduced since more processing steps are needed and that as a result costs increase. Even in lamps which have been completed without faults, the arrangement of the hermetically sealed area itself, with a reliability which must be ensured to prevent breaking of the bulb, especially in lamps with greater than 150 atm, has the disadvantage that the reliability is certainly reduced more dramatically than without this arrangement of the hermetically sealed area.

In the case of the fifth and sixth conventional examples, the degree of technical difficulty may be lower than in the fourth conventional example. The aspects that the production takes much time and that the probability of a fault-free discharge lamp is reduced are however likewise present. There is, therefore, the disadvantage that costs increase. In the case of the sixth conventional example the discharge is carried out in an open space with a high pressure. Therefore, it is assumed that high precision in the dimensioning of the arrangement and the like is required to produce an effective discharge stably and moreover with high efficiency.

In the case of the seventh conventional example, using the conductivity which is induced by the discharge in the auxiliary discharge vessel, a high electrical field is applied to the main discharge space; compared to the arrangement with the close-by conductor in the form of a wire or the like this structure is therefore more indirect and less effective. Furthermore, there is the disadvantage that production of the discharge vessel of the auxiliary UV light source by a thin hollow tube which surrounds the main discharge space like a ring requires very highly developed technology which results in higher costs.

Besides these measures, there is a relatively old example that ionization of the discharge medium is promoted by a radioactive substance such as Krypton 85 or the like being added to the discharge space and that thus an insulation breakdown is simplified. With consideration of the increased interest in the environment in recent years, this solution is not a technology which can be easily used.

SUMMARY OF THE INVENTION

The primary object of the present invention is to eliminate the following through an implementation of a discharge lamp which has an auxiliary light source which is used to produce light with a short wavelength, such as UV radiation or the like, to promote ionization of the discharge medium and to reduce the absolute value of the high voltage which is to be applied during starting. This will remove the disadvantages:

- that the arrangement is complicated and that costs are high; and
- that the probability of producing fault-free products and the reliability of the finished part are increased.

According to the first embodiment of the invention, in a discharge lamp (Ld) in which within the main discharge vessel (Bd) in a discharge space (Zd) for the main discharge which is filled with a discharge medium for the main discharge, there is a pair of opposite electrodes (E1, E2) for the main discharge, and there is a first electrode sealing part and a second electrode sealing part (S1, S2) for connecting the main discharge electrodes (E1, E2). This embodiment further includes a starting electrode (Et), in addition to the main discharge electrodes, which is arranged such that it does not come into contact with the discharge space (Zd) for the main discharge, an auxiliary light source (Lx) which comprises an auxiliary discharge vessel (Bx) which is located adjacent to one side of at least one of the electrode sealing parts (S1, S2) and is not made integral with the electrode sealing parts (S1, S2) and is filled with a discharge medium for the auxiliary discharge, and a first outer electrode (Eu) in the auxiliary light source (Lx) on the outside of the auxiliary discharge vessel (Bx).

In another embodiment according to the invention, the starting electrode (Et) and the first outer electrode (Eu) are electrically connected to one another.

In still another embodiment of the invention, the auxiliary light source (Lx) is on the outside of the auxiliary discharge vessel (Bx) and there is a second outer electrode (Ev). This second outer electrode (Ev) and the main discharge electrode are electrically connected to one another on the side on which the auxiliary light source (Lx) is located.

Another embodiment of the invention includes a first outer electrode (Eu) that is formed by both the electrode sealing part on which the auxiliary discharge vessel (Bx) is located and also the auxiliary discharge vessel (Bx) being wound with a conductive wire.

In another embodiment of the invention, the main discharge electrode is positioned on the side of the discharge vessel on which the auxiliary light source (Lx) is not located, and the starting electrodes (Et) are electrically connected to one another.

In another embodiment of the invention, the main discharge vessel (Bd) and the electrode sealing parts (S1, S2) have an essentially symmetrical arrangement with respect to the middle axis (Ax) and that the distance (RLx) between the auxiliary discharge vessel (Bx) and the middle axis (Ax)

does not exceed the radius (RBd) at the thickest part (Pmax) of the outside shape of the main discharge vessel (Bd).

The invention is further described below using several embodiments shown in the drawings.

DETAILED DESCRIPTION OF THE INVENTION

Figure 1A:
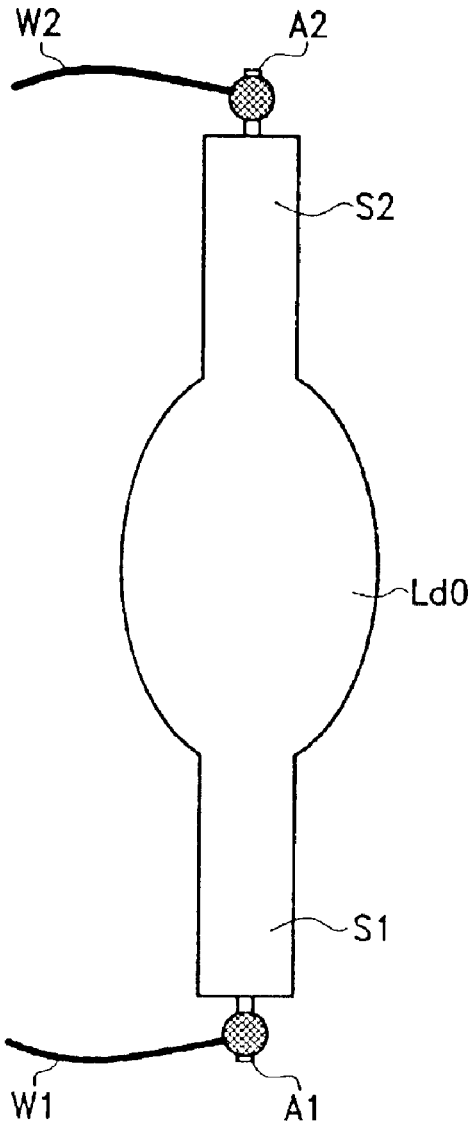
FIGS. 1(*a*) & 1(*b*) each show, in a simplified representation, a schematic of the arrangement of the main part of the discharge lamp (Ld0) of the invention, FIG. 1(*a*) being an outside view and FIG. 1(*b*) being a cross section.
Figure 1B:
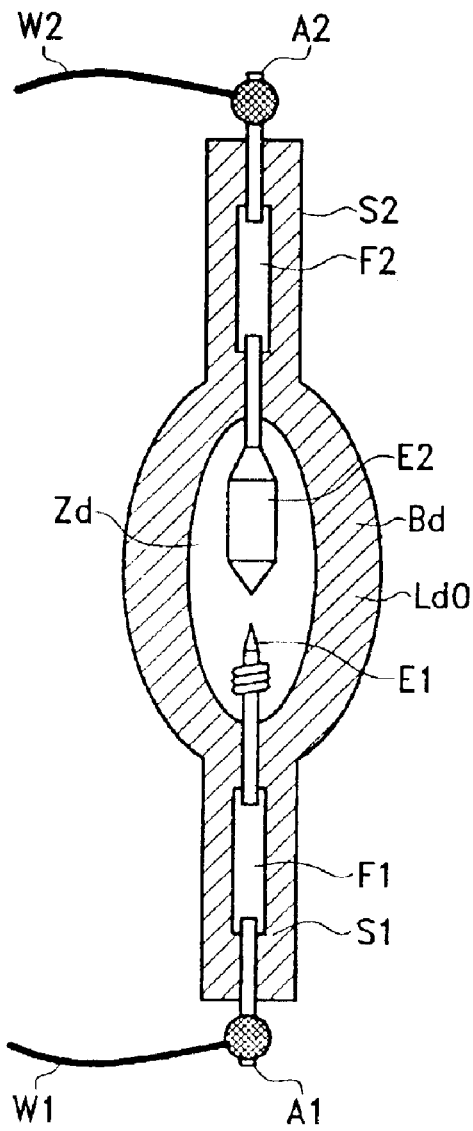

FIGS. 1(*a*) & 1(*b*) show the embodiment of a lamp for direct current operation. For the pair of electrodes (E1, E2) for the main discharge which are located opposite, one electrode (E1) is the cathode and the other electrode (E2) is the anode. The discharge space (Zd) for the main discharge, which is surrounded by the main discharge vessel (Bd) which comprises silica glass or the like, is filled with a discharge medium for the main discharge.

In the electrode sealing parts (S1, S2) which are made integral with the main discharge vessel (Bd) and which also comprise silica glass or the like, there are metal foils (F1, F2) and outer leads (A1, A2) which arc used for electrical connection to the electrodes (E1, E2) from outside the main discharge space (Zd) and for hermetic sealing. The electrode (E1), the metal foil (F1) and the outer lead (A1) are electrically connected to one another by spot welding or the like. Similarly, the electrode (E2), the metal foil (F2) and the outer lead (A2) arc electrically connected to one another by spot welding or the like. Conductive wires (W1, W2) for electrical connection of the outer leads (A1, A2) to a feed device are connected to the outer leads (A1, A2) likewise by spot welding or the like.

FIGS. 1(*a*) and 1(*b*), by way of example, show a case in which the electrodes (E1, E2) are located on an axis and in which the main discharge vessel (Bd) and the electrode sealing parts (S1, S2) are also arranged essentially symmetrically with respect to this axis.

Figure 2A:
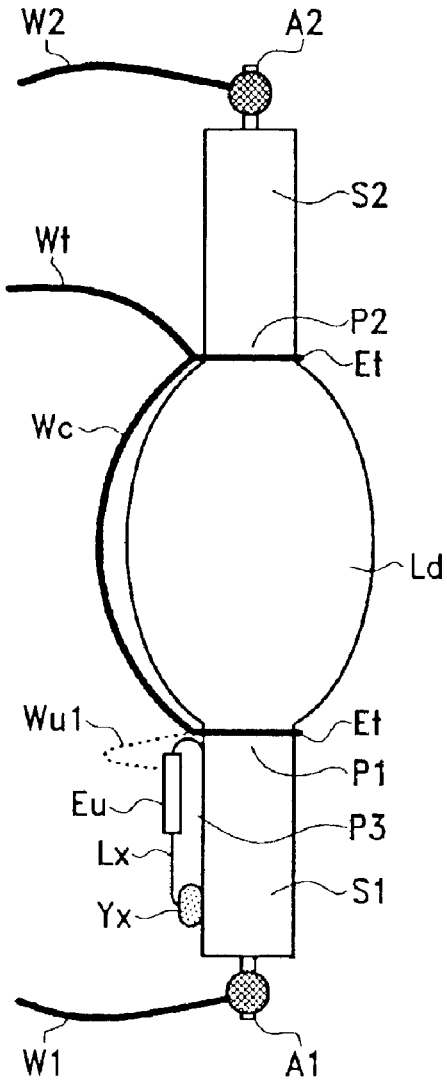
FIGS. 2(*a*) & 2(*b*) each show, in a simplified representation, a schematic of one example of the arrangement of a discharge lamp (Ld) of the outside trigger type of the invention, FIG. 2(*a*) showing the outside view and FIG. 2(*b*) showing the cross section.
Figure 2B:
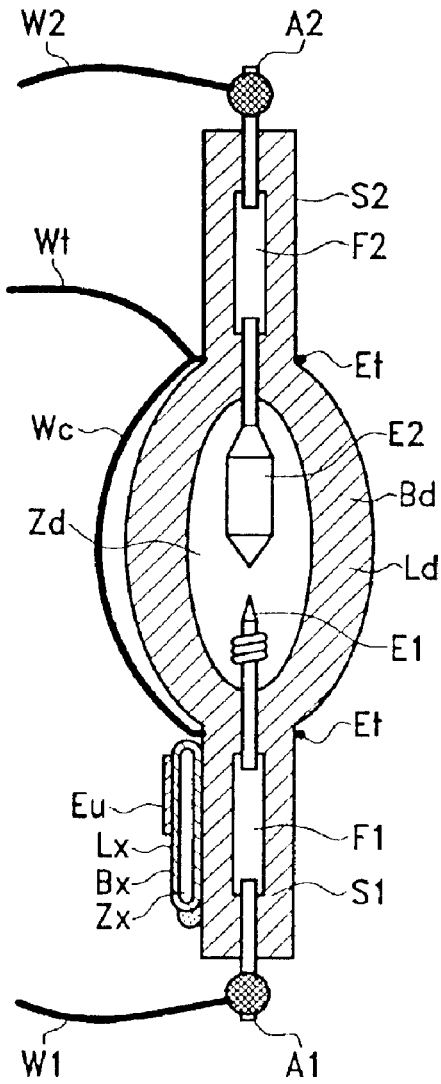

FIGS. 2(*a*) & 2(*b*) each show one example of the arrangement of the discharge lamp (Ld) of the outside trigger type according to the invention in a simplified representation. FIG. 2(*a*) is an outside view. FIG. 2(*b*) is a cross section.

This discharge lamp (Ld) is arranged with respect to the main part of the discharge lamp (Ld0) such that the starting electrodes (Et) which are present in addition to the main discharge electrodes do not come into contact with the discharge space (Zd) for the main discharge. Furthermore, on one side of the electrode sealing part (S1) there is an auxiliary light source (Lx) which comprises a auxiliary discharge vessel (Bx) which is filled with a discharge medium for an auxiliary discharge.

The above described starting electrodes (Et) are located on the cathode side in the vicinity (P1) of the boundary area between the main discharge vessel (Bd) and the electrode sealing part (S1) and in the vicinity (P2) of the boundary area between the main discharge vessel (Bd) and the electrode sealing part (S2) on the anode side. In this embodiment these two starting electrodes are electrically connected to one another by a conductive wire (Wc). If the conductive wire (Wc) is adjacent to the main discharge vessel (Bd), it also acts as a starting electrode. In steady-state operation of the discharge lamp (Ld), the main discharge vessel (Bd) and the electrode sealing part (S1, S2) reach a high temperature. It is, therefore, desirable for the starting electrodes (Et) and the conductive wire (Wc) which are adjacent to them to be formed using a highly heat-resistant metal such as tungsten, an iron-chromium alloy or the like.

Furthermore, a conductive wire (Wt) is connected; it is used for its electrical connection to the feed device. Moreover, the starting electrodes (Et) can also be formed by the main part of the discharge lamp (Ld0) being wound with a conductive wire.

A high voltage generating part of the feed device which comprises a high voltage transformer or the like is connected such that between the conductive wire (Wt) and for example the outer lead (A1) on the cathode side a high voltage is applied.

When the discharge lamp (Ld) is started, in the state in which between the outer leads (A1, A2) of the two poles a no-load voltage is applied, a high voltage is applied between the conductive wire (Wt) and the outer lead (A1) on the cathode side. Between the inside of the main discharge vessel (Bd) and the cathode (E1) and between the inside of the main discharge vessel (Bd) and the anode (E2) thus a high voltage is applied, producing a dielectric barrier discharge. By promoting ionization of the discharge medium, starting of the discharge is induced in the gap between the electrodes (E1, E2) for the main discharge.

On the side of the outside of the auxiliary discharge vessel (Bx) which is opposite the area (P3) and the electrode sealing part (S1) there is the first outer electrode (Eu). The high voltage generating part of the feed device, which comprises a high voltage transformer or the like, is connected such that a high voltage is applied between the first outer electrode (Eu) and for example the outer lead (A1) of the cathode side.

If, when the discharge lamp (Ld) is started, between the first outer electrode (Eu) and the outer lead (A1) of the cathode side a high voltage is applied, the conductors which consist of the cathode (E1) the metal foil (F1) and the outer lead (A1) and which are present within the area of the electrode sealing part (S1) to which the auxiliary discharge vessel (Bx) is adjacent, are connected to one another and to a second outer electrode between which and the first outer electrode (Eu) a high voltage is applied. In an auxiliary discharge space (Zx) in the auxiliary discharge vessel (Bx) a dielectric barrier discharge is formed.

By choosing the material which produces light (normally UV radiation) with a wavelength which is suitable for ionization of the main discharge medium, which has been added to the discharge space (Zd) for the main discharge of the main discharge vessel (Bd), is added to the auxiliary discharge space (Zx) of the auxiliary discharge vessel (Bx) the light emitted when the dielectric barrier discharge forms in the auxiliary discharge space (Zx) propagates in the electrode sealing part (S1), travels to the discharge space (Zd) for the main discharge and ionizes the discharge medium for the main discharge which was added to the discharge space (Zd) for the main discharge, by which the formation of the dielectric barrier discharge between the inside of the main discharge vessel (Bd) and the cathode (E1) or the anode (E2) is promoted and by which at the same time the formation of a discharge in the gap between the electrodes (E1, E2) for the main discharge is promoted. Therefore, the start of the main discharge can be effectively induced and as a result the absolute value of the high voltage which is to be applied to the conductive wire (Wt) can be reduced.

Here, the important point is that the auxiliary discharge space (Zx) for the following reason has a far lower temperature than the discharge space (Zd) for the main discharge:

The cooling rate of the auxiliary discharge space (Zx) after the discharge lamp (Ld) is turned off is far higher than that of the discharge space (Zd) for the main discharge because during operation of the discharge lamp (Ld) in the auxiliary discharge space (Zx) no discharge takes place and because the auxiliary discharge vessel (Bx) is not made integral with the electrode sealing parts (S1, S2) and the main discharge vessel (Bd).

Furthermore, another important point is that the composition of the discharge medium which is to be added to the auxiliary discharge vessel (Bx), i.e., the mixing ratio, the filling pressure and the like of the added substance, regardless of that of the discharge medium which has been added to the main discharge vessel (Bd), can be regulated.

Here, the non-integral inclusion of the auxiliary discharge vessel (Bx) with the electrode sealing parts (S1, S2) means that the auxiliary discharge vessel (Bx) is not installed in the electrode sealing parts (S1, S2) or that the auxiliary discharge vessel (Bx) is fused integrally to the electrode sealing parts (S1, S2) by melting when, for example, the auxiliary discharge vessel (Bx) and the electrode sealing parts (S1, S2) comprise a glass material, such as silica glass or the like. When the auxiliary discharge vessel (Bx) is installed on the electrode sealing parts (S1, S2) it can be held by winding for example with a wire or a metal strip or can be cemented and attached for example with cement or the like.

The above described phenomenon that the voltage necessary for an insulation breakdown changes depending on the temperature of the discharge vessel does not occur distinctly in the auxiliary discharge space (Zx). Under the condition of a hot restart, the dielectric barrier discharge can also be easily produced in the auxiliary discharge space (Zx) and as a result the time interval in which starting of the discharge lamp is not possible can be shortened.

The discharge medium which is added to the auxiliary discharge vessel (Bx) can therefore be a gas which emits UV radiation, such as argon, nitrogen or the like. If memory is added to the main discharge vessel (Bd), light is easily produced with a spectrum which is effective for ionization in the discharge space for the main discharge. It is, therefore, effective to also add a small amount of mercury to the auxiliary discharge vessel (Bx).

The discharge takes place more easily with the lower the fill pressure of the discharge medium added to the auxiliary discharge vessel (Bx). However, since the emission amount decreases, a suitable value can be chosen from a range of 5 hPa to 100 hPa. In the case of a dielectric barrier discharge in which there is no inner electrode at all, as in the auxiliary discharge vessel (Bx) of the auxiliary light source (Lx) of the invention, the result is that a lower voltage the dielectric barrier discharge can be produced:

The discharge vessel is filled with a conductive body, for example powder or a thin wire, such as of metal, graphite, carbon nanotube or the like, in a small amount. In this way the electrical field within the auxiliary discharge space (Zx) is distorted and a high electrical field is produced locally. For the material for the auxiliary discharge vessel (Bx) of course a material should be chosen which has high transmittance with respect to light with that wavelength which is suitable for ionization of the discharge medium for the main discharge which has been produced in the auxiliary discharge space (Zx) and which furthermore withstands the high temperature in steady-state operation in the discharge space (Zd) for the main discharge. For example, silica glass is suited as that material.

When the discharge lamp (Ld) is started, it is necessary to apply the high voltage both to the first outer electrode (Eu) and also to the starting electrode (Et). However, since, as was described above, the light from the auxiliary light source (Lx) due to ionization of the discharge medium for the main discharge not only has the action of promoting the formation of the discharge in the gap between the electrodes (E1, E2) for the main discharge, but also the action of promoting the formation of the dielectric barrier discharge between the inside of the main discharge vessel (Bd) and the cathode (E1) or the anode (E2), it is desirable to apply high voltage to the first outer electrode (Eu) earlier than the starting electrode (Et).

Further, if there are therefore two high voltage generating parts, or if there is a delay circuit and the light source device is arranged such that the timing with which the high voltage is applied to the starting electrode (Et) is delayed more than to the first outer electrode (Eu), costs increase. This occurs even if high voltage from the same source is applied to the first outer electrode (Eu) and also to the starting electrode (Et). Therefore, the action of reducing the costs by simplification of the arrangement can be obtained if, compared to the following case, the increase in the absolute value of the required high voltage may be ignored.

If the high voltage is applied to the first outer electrode (Eu) earlier than to the starting electrode (Et) by the following benefits result:

that the high voltage which is to be applied is prevented from not becoming a pulse with an extremely short duration; or that the high voltage to be applied is not made into a one-time pulse, but is made into several pulses which form with a short time interval.

In this case, this can be accomplished by a connection of the first outer electrode (Eu) to the starting electrode (Et) by means of a conductive wire (Wu1).

For attaching the auxiliary discharge vessel (Bx) on the side of the electrode sealing part (S1), as is shown in FIGS. 2(*a*) & 2(*b*), in the part of the auxiliary discharge vessel (Bx) which is farthest away from the main discharge vessel (Bd) and which reaches a high temperature during steady-state operation, there is an attachment part (Yx) of cement or the like.

As was described above, in the discharge lamp of the invention, by using an extension part of the conductive wire comprising the starting electrode (Et), or by similar measures, the line for applying the high voltage to the auxiliary light source (Lx) can be easily installed. Furthermore, the attachment of the auxiliary light source (Lx) in the main part of the discharge lamp (Ld0) can also be easily carried out. Therefore, the discharge lamp of the invention can be implemented with low costs because material costs can be saved and because installation is simple.

Since in the auxiliary discharge vessel (Bx) of the auxiliary light source (Lx) there is no inner electrode, a hermetically sealed arrangement is not necessary. In this way there are the advantages that production of the auxiliary discharge vessel itself is not time-consuming, that it can be done with low costs and that moreover reliability is high.

Since in the production of the main part of the discharge lamp (Ld0) the electrodes (E1, E2) for the main discharge, the metal foils (F1, F2), the outer leads (A1, A2), the main discharge vessel (Bd) and the electrode sealing parts (S1, S2) can be arranged in the conventional manner, there is the major advantage that by the use of the auxiliary light source (Lx) of the invention, the quality of the main part of the discharge lamp (Ld0) or the reliability of the finished part or similar factors can be prevented from decreasing.

In the arrangement of the starting electrode (Et) in the discharge lamp to ensure that it does not come into contact with the discharge space (Zd) for the main discharge, the starting electrode (Et) can be arranged such that:

The starting electrode (Et) is installed in the main discharge vessel (Bd);

The starting electrode (Et) is brought into contact with the outside of the main discharge vessel (Bd) or The starting electrode (Et) is located in the vicinity of the outside of the main discharge vessel (Bd).

If the above described advantage that in the arrangement of the main part of the discharge lamp (Ld0) conventional features are used, it is, however, desirable to bring the starting electrode (Et) into contact with the outside of the main discharge vessel (Bd) or to place it in the vicinity of the outside of the main discharge vessel (Bd).

In the formation of the first outer electrode (Eu), the following optional methods can be used so that on the outside of the auxiliary discharge vessel (Bx) there is a conductive body:

A conductive paste is applied;

A metallic thin layer is vapor-deposited;

A metal piece is cemented via a dielectric such as cement or the like.

Figure 3A:
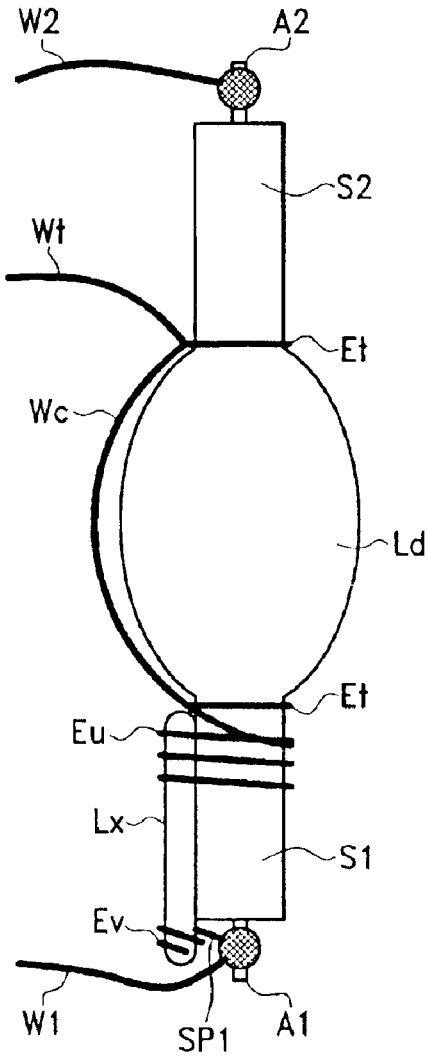
FIGS. 3(*a*) and 3(*b*) each show, in a simplified representation, a schematic of another example of the arrangement of a discharge lamp (Ld) of the outside trigger type of the invention, FIG. 3(*a*) showing the outside view and FIG. 3(*b*) showing the cross section.
Figure 3B:
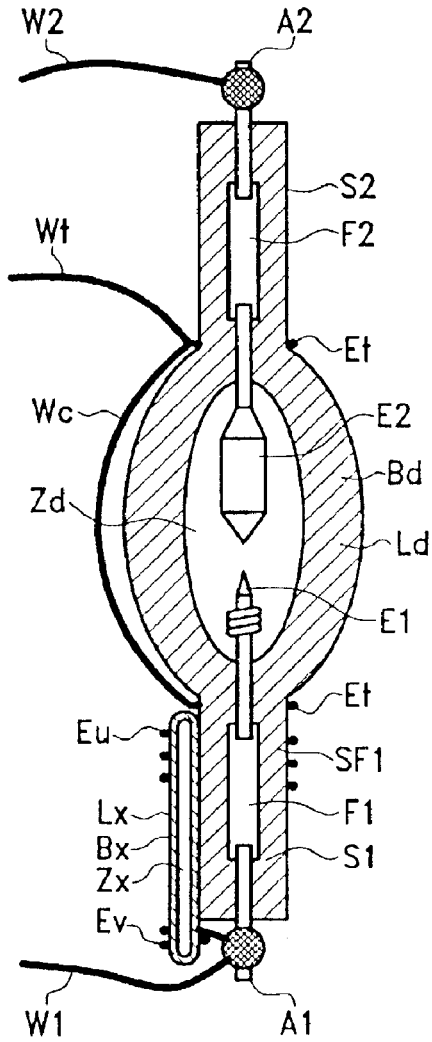

FIGS. 3(*a*) & 3(*b*) each show another example of the arrangement of a discharge lamp (Ld) of the outside trigger type of the invention in a simplified representation. FIG. 3(*a*) is an outside view, and FIG. 3(*b*) is a cross section.

In FIGS. 2(*a*) & 2(*b*), the arrangement is used that the conductors which are present within part of the electrode sealing part (S1) to which the auxiliary discharge vessel (Bx) is adjacent, and which include the cathode (E1), the metal foil (F1) and the outer lead (A1), by themselves become the second outer electrode. But, as is shown in FIGS. 3(*a*) & 3(*b*), a second outer electrode (Ev) can be actively placed adjacent to the auxiliary discharge vessel (Bx) and it can be electrically connected to the outer lead (A1) which belongs to the electrode sealing part (S1) on the side on which the auxiliary light source (Lx) is located.

In the embodiment where the auxiliary light source (Lx) is on the outside of the auxiliary discharge vessel (Bx), there is a second outer electrode (Ev) and that in this way electrical connection is reliably carried out, the thickness of the dielectric between the second outer electrode (Ev) and the auxiliary discharge space (Zx) is essentially identical to the thickness of the auxiliary discharge vessel (Bx). Since the thickness of the dielectric is reduced more than in the cases shown in FIGS. 2(*a*) and (*b*), the advantages are the following:

The dielectric barrier discharge in the auxiliary discharge space (Zx) can be produced at a lower voltage or the pressure of the auxiliary discharge space (Zx) can be increased and thus the amount of emission from the auxiliary discharge space can be increased; and Operation of the auxiliary light source (Lx) is stabilized because the electrical property of the auxiliary light source (Lx) is no longer dependent on the concave-convex surface composition of the side of the electrode sealing part (S1) on which the auxiliary light source (Lx) is located.

In FIGS. 3(*a*) & 3(*b*), the first outer electrode (Eu) is formed by both the electrode sealing part (S1) on which the auxiliary discharge vessel (Bx) is located and also the auxiliary discharge vessel (Bx) being wound with a conductive wire using the extension part of the conductive wire comprising the starting electrode (Et). Upon doing this, the outer electrode of the auxiliary light source (Lx) can be formed by a simple arrangement and electrical connection can be done with certainty. Thus, it can also function as an attachment means for the auxiliary light source (Lx); this is advantageous with respect to the cost reduction. Of course an attachment part (Yx) of cement or the like which is shown in FIGS. 2(*a*) & 2(*b*) can also be used.

In FIGS. 3(*a*) & 3(*b*), the second outer electrode (Ev) is formed by the end of the auxiliary discharge vessel (Bx) being wound with a conductive wire which is connected to the outer lead (A1) on the cathode side. Here too, the outer electrode can be formed by a simple arrangement and electrical connection can be carried out with certainty.

Moreover it can also act as an attachment means for the auxiliary light source (Lx); this is advantageous with respect to cost reduction. The conductive wire which is wound as the second outer electrode (Ev) around the auxiliary discharge vessel (Bx) can also be implemented by lengthening the conductive wire (W1) which is connected to the outer lead (A1).

The second outer electrode (Ev) is of course an outer electrode and by electrostatic coupling induces a dielectric barrier discharge in the auxiliary discharge space (Zx). Cement or the like can be applied to the part in which the conductive wire is wound as the second outer electrode (Ev) around the auxiliary discharge vessel (Bx) for its stable attachment.

The second outer electrode (Ev) can, moreover, also be formed around the auxiliary discharge vessel (Bx) for example by application of a conductive paste. The connection of the outer lead (A1) to the second outer electrode (Ev) can, furthermore, be accomplished by, for example, a conductive paste being applied to one end (SP1) of the electrode sealing part (S1) so that the second outer electrode (Ev) and the outer lead (A1) are also electrically connected to one another. Because it also acts as the attachment of the auxiliary discharge vessel (Bx), the arrangement can also be simplified, the working sequences for processing can be reduced and thus also the costs reduced.

Figure 4A:
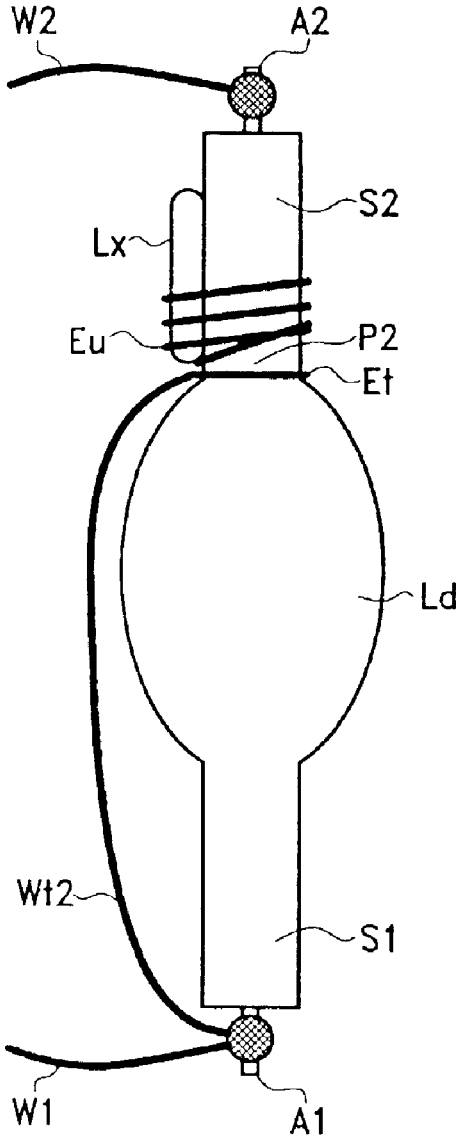
FIGS. 4(*a*) & 4(*b*) each show, in a simplified representation, a schematic of one example of the arrangement of a discharge lamp (Ld) of the inside trigger type of the invention, FIG. 4(*a*) showing the outside view and FIG. 4(*b*) showing the cross section.
Figure 4B:
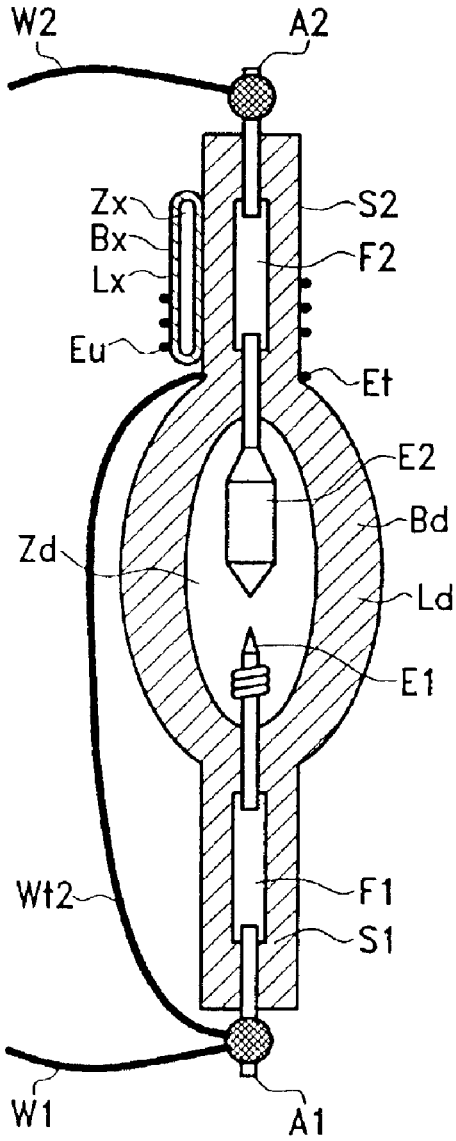

FIGS. 4(*a*) & 4(*b*) each show an example of a discharge vessel (Ld) of the inner trigger type of the invention, in which the lamp is started by applying a high voltage between the electrodes (E1, E2) for the main discharge. FIG. 4(*a*) is an outside view. FIG. 4(*b*) is a cross section.

This discharge lamp is arranged with respect to the main part of the discharge lamp (Ld0) such that the starting electrode (Et) which is present in addition to the main discharge electrodes does not come into contact with the discharge space (Zd) for the main discharge. Furthermore, the auxiliary light source (Lx), which includes an auxiliary discharge vessel (Bx) which is filled with the discharge medium for the auxiliary discharge, is located on one side of the electrode sealing part (S2) on the anode side. Moreover, the starting electrode (Et) and the outer lead (A1) are electrically connected to one another on the cathode side which is connected to the electrode on the side which is opposite the side on which the auxiliary light source (Lx) is located, by means of a conductive wire (Wt2).

In this arrangement of the discharge lamp (Ld), the conductive wire (Wt) is no longer needed for the connection to the high voltage generating part which is located in the discharge lamp shown in FIGS. 2(*a*) & 2(*b*). This is advantageous when the number of cables for electrical connection of the discharge lamp to the feed device is to be reduced.

The starting electrode (Et) is formed by a conductive wire being wound around the main part of the discharge lamp (Ld0) in the vicinity (P2) of the boundary area to the electrode sealing part (S2) on the anode side.

When this discharge lamp is started, between the electrodes (E1, E2) for the main discharge, a high voltage is applied by the no-load voltage and the high voltage being applied superimposed between the outer leads (A1, A2) of the two poles. At the same time a high voltage is also applied by the function of the starting electrode (Et) between the inside of the main discharge vessel (Bd) and the anode (E2), by which a dielectric barrier discharge is formed and by which the ionization of the discharge medium is promoted. In this way an insulation breakdown is induced between the electrodes (E1, E2) for the main discharge.

The first outer electrode (Eu) of the auxiliary light source (Lx) is formed around both the electrode sealing part (S2) on which the auxiliary discharge vessel (Bx) is located and also the auxiliary discharge vessel (Bx) with a conductive wire formed as an extension part of the conductive wire comprising the starting electrode (Et).

Since the first outer electrode (Eu) and the outer lead (A1) on the cathode side are electrically connected with conductive wire (Wt2) (via the starting electrode (Et)) by the no-load voltage and the high voltage being applied superimposed between the outer leads (A1, A2) of the two poles when the discharge lamp (Ld) is started, the conductor which forms the anode (E2), the metal foil (F2) and the outer lead (A2) and which is present within the area of the electrode sealing part (S2) to which the auxiliary discharge vessel (Bx) is adjacent is formed integrally with one another and to the second outer electrode between which and the first outer electrode (Eu) a high voltage is applied. In the auxiliary discharge space (Zx) in the auxiliary discharge vessel (Bx), a dielectric barrier discharge is formed.

The light emitted in this way from the auxiliary light source (Lx) due to ionization of the discharge medium for the main discharge also promotes the formation of a dielectric barrier discharge between the inside of the main discharge vessel (Bd) and the anode (E2), at the same time promotes the formation of a discharge in the gap between the electrodes (E1, E2) for the main discharge and as a result thereof can reduce the absolute value of the high voltage which is to be applied to the conductive wire (Wt).

Figure 5:
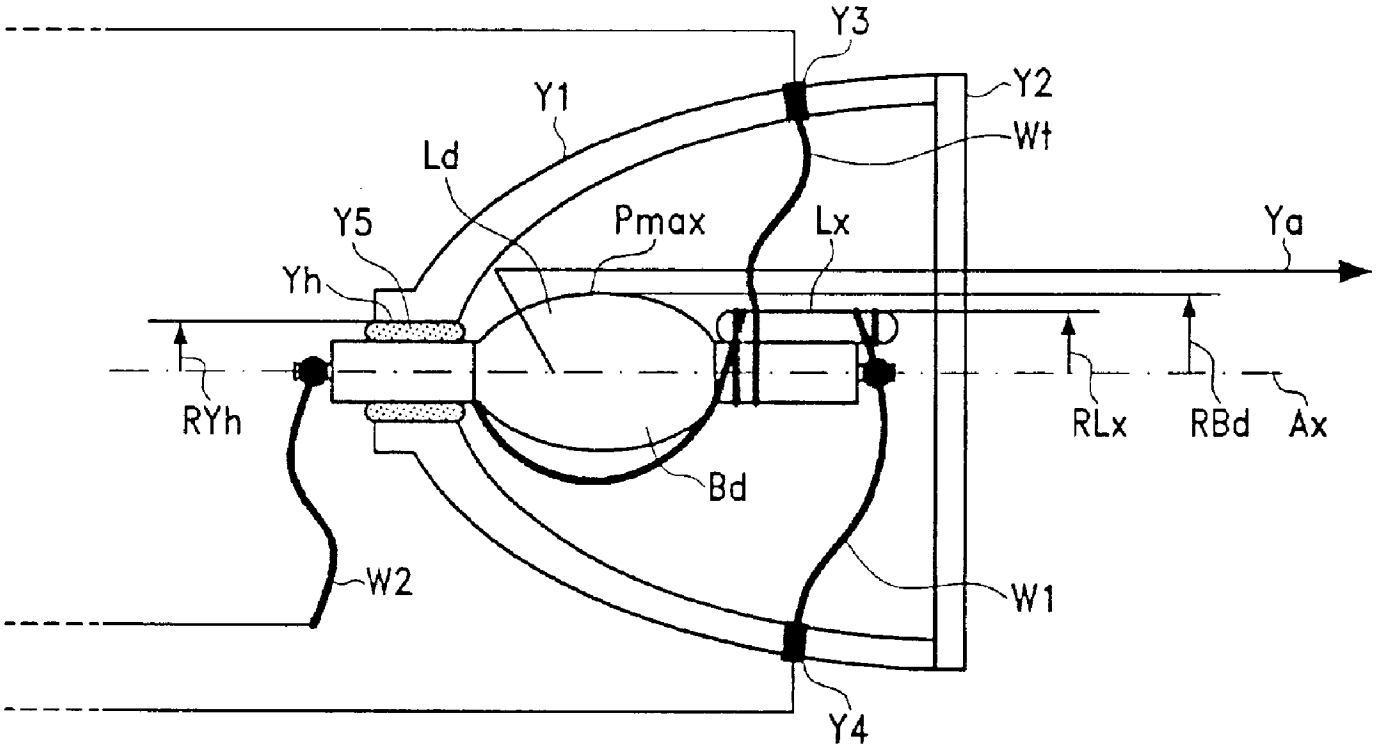
FIG. 5 shows, in a simplified representation, a schematic of one example of the arrangement of a discharge lamp (Ld) of the invention, where it is located in a reflector (Y1), shown in simplified form.

FIG. 5 shows another arrangement of a discharge lamp (Ld) of the invention in which a structure is shown in which it is installed in a reflector (Y1) which has a reflection surface for example in the shape of a paraboloid of revolution and which is used for emergence of the emission of the discharge lamp (Ld) in a certain direction.

In this situation, in the case of an unduly large size of the auxiliary light source located in the main part of the discharge lamp (Ld0) the disadvantage arises that from the light ray pencil which has formed in the gap between the electrodes (E1, E2) for the main discharge of the discharge lamp (Ld) and which has been reflected by the reflector (Y1) the light ray (Ya) which tries to pass through the vicinity of the main discharge vessel (Bd) is shielded by the auxiliary light source and that therefore the degree of utilization of the light is reduced.

To prevent this disadvantage from arising and thus to increase the degree of light utilization and to implement a discharge lamp (Ld) with high efficiency, in FIG. 5 the ratio of the dimensions of the auxiliary light source (Lx) has been fixed such that the distance (RLx) between the part of the auxiliary discharge vessel (Bx) which is farthest away from the middle axis (Ax) and the middle axis (Ax) does not exceed the radius (RBd) in the thickest part (Pmax) of the outside shape of the main discharge vessel (Bd).

When the reflection surface of the reflector (Y1) has a reflection surface in the shape of a paraboloid of revolution, the light ray pencil which has been reflected by the reflector (Y1) the light ray (Ya) tries to pass through the vicinity of the main discharge vessel (Bd) is not exactly parallel, but essentially parallel to the middle axis (Ax). In the arrangement with the ratio of the dimensions with respect to the auxiliary light source (Lx) there is therefore no disadvantage.

FIG. 5 shows, also by way of example, a state in which there is a light exit window (Y2) which jackets the front of the reflector (Y1) and in which the discharge lamp (Ld) and the reflector (Y1) are attached in a lamp attachment opening (Yh) by the arrangement of an attachment part (Y5) of cement or the like. Furthermore, it is shown here, by way of example, that the conductive wire (Wt) to which the starting electrode (Et) and the first outer electrode (Eu) of the auxiliary light source (Lx) are connected is made electrically connectable to the outer part of the reflector (Y1), for example via an eye (Y3).

In this embodiment, by way of example, it is shown that the side on which the auxiliary light source (Lx) is located is the electrode sealing part (S1) on the cathode side and in which the conductive wire (W1) can be electrically connected to the outer part of the reflector (Y1) for example via an eye (Y4). However, it can also be arranged such that the side on which the auxiliary light source (Lx) is located is the electrode sealing part (S2) on the anode side.

FIG. 5 shows the state in which in the electrode sealing part on the side which is opposite the side on which the auxiliary light source (Lx) is located, the discharge lamp (Ld) and the reflector (Y1) are attached to one another. However, the discharge lamp (Ld) and the reflector (Y1) can also be attached to one another in the electrode sealing part on the side on which the auxiliary light source (Lx) is located.

However, in this case, the ratio of the dimensions of the auxiliary light source (Lx) taken exactly should be fixed such that the distance (RLx) between the part of the auxiliary discharge vessel (Bx) which is farthest away from the middle axis (Ax) and the middle axis (Ax) does not exceed the radius (RYh) of the lamp attachment opening (Yh). However, it is normally possible to arrange the discharge lamp (Ld) in this case by the following measures with the dimensional ratio of the auxiliary light source (Lx):

that the discharge lamp (Lx) is mounted in the reflector (Y1) such that its middle axis (Ax) essentially agrees with the middle axis of the reflector (Y1).

that the radius (RYh) of the lamp attachment opening (Yh) is roughly identical to the radius (RBd) in the thickest part (Pmax) of the outside shape of the main discharge vessel (Bd) or does not exceed it, so that with respect to the degree of utilization of the light from the light ray pencil which has been formed in the gap between the electrodes (E1, E2) for the main discharge of the discharge lamp (Ld) and which has been reflected by the reflector (Y1) the light ray (Ya) which tries to pass through the vicinity of the main discharge vessel (Bd) can in fact be reflected by the reflector (Y1).

Figure 6A:
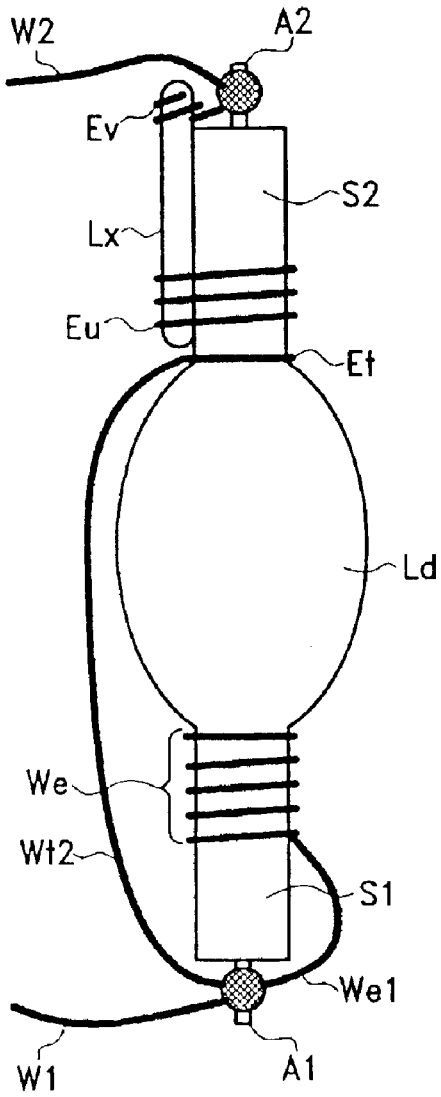
FIGS. 6(*a*) & 6(*b*) each show, in a simplified representation, another schematic of one example of the arrangement of a discharge lamp (Ld) of the inside trigger type of the invention, FIG. 6(*a*) showing the outside view and FIG. 6(*b*) showing the cross section.
Figure 6B:
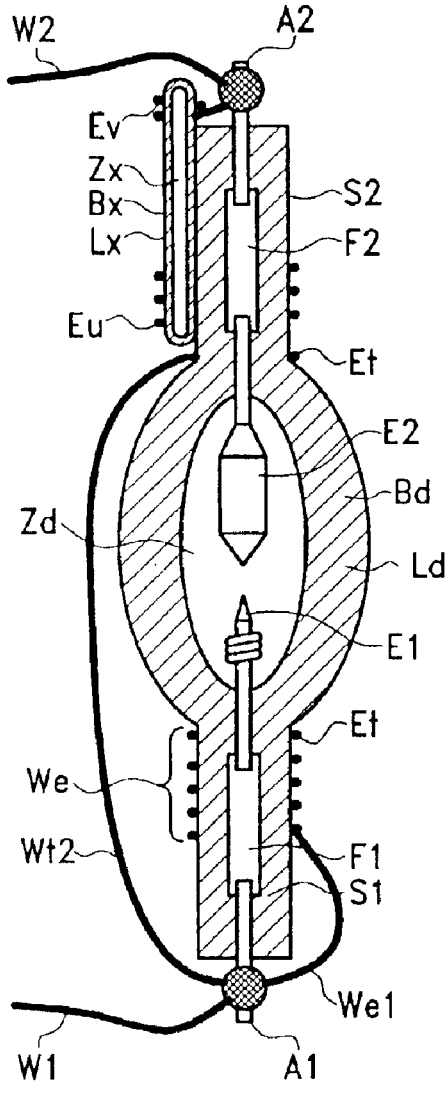

FIGS. 6(*a*) & 6(*b*) each show an example of the arrangement of a discharge lamp (Ld) of the inside trigger type of the invention. FIG. 6(*a*) shows the outside view and FIG. 6(*b*) shows the cross section. In the figures, for the discharge lamp (Ld), the auxiliary light source (Lx) is located on the electrode sealing part (S2) on the anode side.

As in the discharge lamp shown in FIGS. 3(*a*) & 3(*b*), a second outer electrode (Ev) is actively located adjacent to the auxiliary discharge vessel (Bx) and is electrically connected to the outer lead (A1) which belongs to the electrode sealing part (S2) on the side on which the auxiliary light source (Lx) is located. Therefore the following advantages arise:

the dielectric barrier discharge can be produced at a lower voltage or the pressure of the auxiliary discharge space (Zx) can be increased and operation is stabilized because the electrical property of the auxiliary light source (Lx) is no longer dependent on the concave-convex surface composition of the side of the electrode sealing part (S2) on which the auxiliary light source (Lx) is located.

In the discharge lamp (Ld) shown in FIGS. 6(*a*) & 6(*b*), a coil-like conductive wire (We) is wound in such a way that it surrounds the hermetically sealed area (SF1) on the cathode side of the electrode sealing part (S1) of the anode side. It is connected to the outer lead (A1) of the cathode side via a conductive wire (We1).

Since, in the operating state of the discharge lamp (Ld), no current flows in the conductive wire (We) and in the conductive wire (We1), a state with the same electrical potential as the outer lead (A1) on the cathode side is maintained in the conductive wire (We).

A conductive body, which is arranged such that it surrounds the hermetically sealed area (SF1) on the cathode side, like the conductive wire (We), and in which during the interval during which essentially the main discharge of the discharge lamp forms, a state with the same electrical potential as the outer lead (A1) is maintained on the cathode side, is called a "cathode conductor with the same electrical potential" in these application documents.

On the other hand, in the line between the tip of the cathode (E1) and the outer lead (A1) of the cathode side, the current of the main discharge of the discharge lamp (Ld) flows, by which a voltage reduction occurs which is proportional to the product of the resistance value of this line and the value of the flowing current. The closer the tip of the cathode (E1) is approached, the higher the electrical potential becomes.

By the function of the conductive wire (We) as a cathode conductor with the same electrical potential, the metallic cations of the impurities which are contained in the hermetic sealing material, as is described in Japanese patent HEI 4-40828, in the hermetically sealed area (SF1) on the cathode side of the lamp which in the operating state has reached a high temperature, are driven in the direction in which they move away from the electrode material comprising the cathode. This prevents the phenomenon that by the accumulation of metallic cations of impurities on the surface of the electrode material the glass material of the hermetically sealed part of the discharge vessel, such as silica glass or the like, and the electrode material detach from one another. In the embodiment of the lamp arrangement shown in FIGS. 6(*a*) & 6(*b*), therefore, the effect of preventing the disadvantage of lamp damage as a result of the detachment phenomenon is realized. In the case of an alternating current type of lamp operation, the cathode conductor with the same electrical potential can be omitted.

Figure 7:
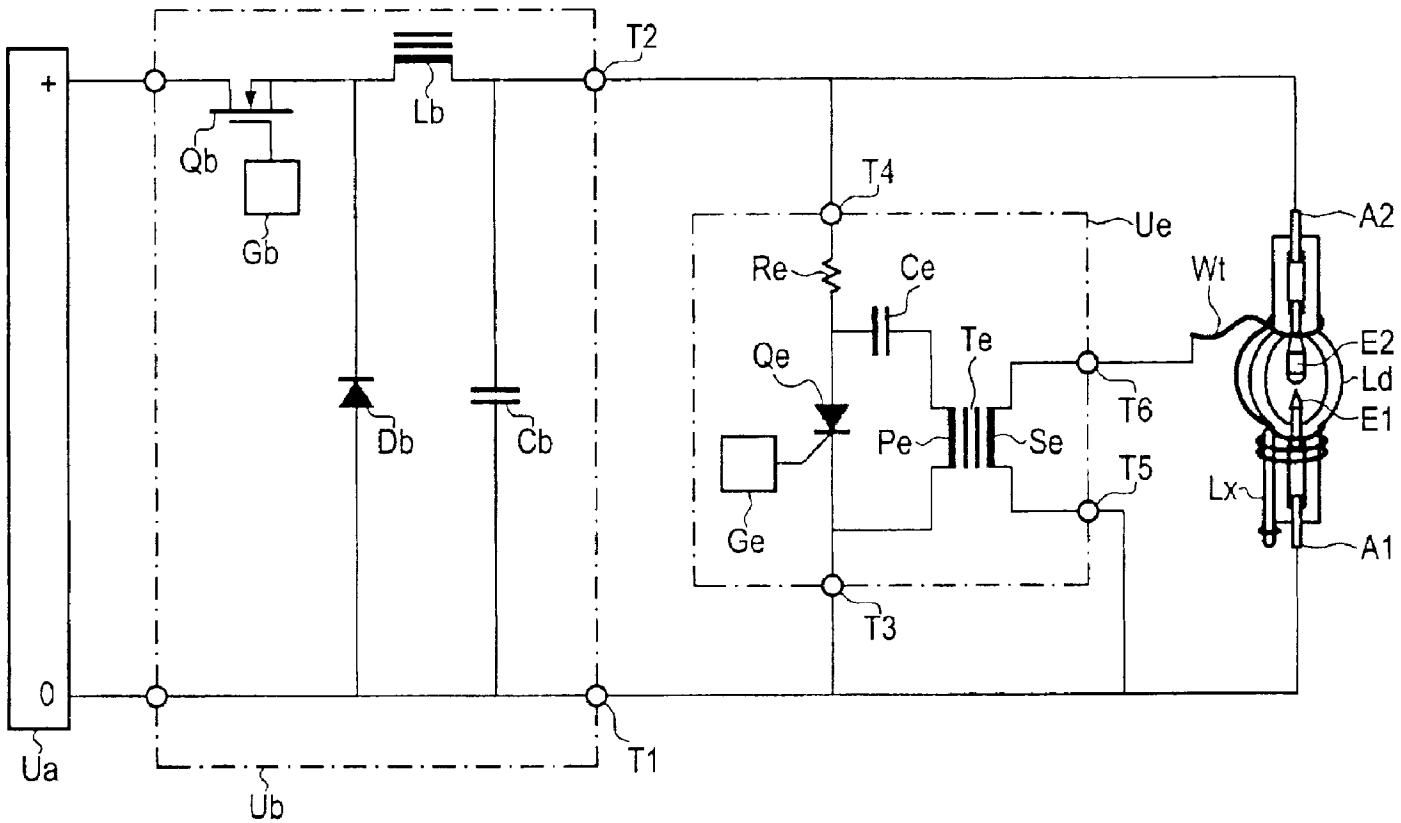
FIG. 7 shows, in a simplified representation, a schematic of an example of the operating situation of a discharge lamp of the outside trigger type of the invention using a feed device of the direct current operating type.

FIG. 7 shows in a simplified representation an example of the discharge lamp of the outside trigger type of the invention operated using a feed device of the direct current operating type. FIG. 7 shows an example of the discharge lamp (Ld) in which the lamp described above using FIGS. 3(*a*) & 3(*b*) is connected. In this figure, the reference letters (Ub) label a feed circuit to which a direct current source (Ua), such as a PFC (power factor corrector) or the like, is connected as the power source. The outer leads (A1, A2) of the discharge lamp (Ld) are connected to the output terminals (T1, T2) of the feed circuit (Ub).

A feed circuit of the voltage reduction chopper type is shown by way of example as the feed circuit (Ub). Here, by means of a switching device (Qb), such as a FET or the like, the current from the direct current source (Ua) is turned on or off. If the switching device (Qb) is in the ON state, the direct current source (Ua) via a choke (Lb) charges a smoothing capacitor (Cb) and current is supplied to the discharge lamp (Ld). When the switching device (Qb) is in the OFF state, by the induction action of the choke (Lb) the smoothing capacitor (Cb) is charged via the diode (Db) and current is supplied to the discharge lamp (Ld). A gate signal with a suitable pulse duty factor from the gate driver circuit (Gb) is delivered to the switching device (Qb) such that the discharge current which is flowing between the electrodes (E1, E2) for the main discharge of the lamp (Ld), the voltage between the electrodes (E1, E2) for the main discharge or the lamp wattage as a product of this current and this voltage has a suitable value which corresponds to the state of the discharge lamp (Ld) at this time.

Normally, for suitable control of the lamp current, the lamp voltage or the lamp wattage there is a resistor divider or shunt resistor for determining the voltage of the smoothing capacitor (Cb) and the current supplied to the discharge lamp (Ld). Furthermore, normally there is a control circuit which makes it possible for the gate driver circuit (Gb) to produce a suitable gate signal. They are however not shown in FIG. 7.

In the case of operation of the discharge lamp (Ld), before starting, a no-load voltage is applied between the electrodes (E1, E2) for the main discharge of the discharge lamp (Ld). Since the input point (T4) and the grounding point (T3) of the starter (Ue) are connected parallel to the discharge lamp (Ld), the same voltage as the voltage which has been applied to the discharge lamp (LD) is also supplied to the starter (Ue). When this voltage is received at the starter (Ue) a capacitor (Ce) is charged via a resistor (Re).

By closing a switching device Qe such as a SCR thyristor or the like, by a gate driver circuit (Ge) with suitable timing the charging voltage of the capacitor (Ce) is applied to the primary winding (Pe) of a high voltage transformer (Te). In the secondary winding (Se) of the high voltage transformer (Te) therefore an increased voltage which corresponds to the arrangement of the high voltage transformer (Te) is formed. In this case the voltage which has been applied to the primary winding (Pe) quickly decreases according to the discharge of the capacitor (Ce). The voltage which forms in the secondary winding (Se) therefore becomes a pulse.

One end of the secondary winding (Se) of the high voltage transformer (Te) is connected via the output terminal (T5) of the starter (Ue) to one of the electrodes of the discharge lamp (Ld), specifically to one electrode (the cathode in this case), and the second outer electrode (Ev) of the auxiliary light source (Lx). The other end of the secondary winding (Se) of the high voltage transformer (Te) is connected via the output terminal (T6) of the starter (Ue) to the starting electrode (Et) which is located outside the main discharge vessel (Bd) of the discharge lamp (Ld) and to the first outer electrode (Eu) of the auxiliary light source (Lx). By means of the high voltage which forms in the seconding winding (Se) of the high voltage transformer (Te) in the auxiliary discharge space (Zx) of the auxiliary light source (Lx) (i.e. between the inner sides of the auxiliary discharge vessel (Bx) which are present opposite with respect to the first and second outer electrodes (Eu, Ev) of the auxiliary light source (Lx), the dielectric of the auxiliary discharge vessel (Bx) being present between these inner sides) a dielectric barrier discharge is produced. Furthermore, between the electrodes (E1, E2) for the main discharge of the discharge lamp (Ld) and the inside of the main discharge vessel (Bd) of the discharge lamp (Ld) a dielectric barrier discharge is formed.

The light emitted in this way from the auxiliary light source (Lx) due to ionization of the discharge medium for the main discharge also promotes the formation of the dielectric barrier discharge between the inside of the main discharge vessel (Bd) and the cathode (E1), and between the inside of the main discharge vessel (Bd) and the anode (E2), at the same time promotes the formation of a discharge in the gap between the electrodes (E1, E2) for the main discharge and as a result thereof can reduce the absolute value of the high voltage which is to be applied to the conductive wire (Wt).

FIG. 7 showed a case in which the output terminals (T5, T6) of the starter (Ue) are connected between the cathode (E1) of the discharge lamp (Ld) and the starter electrode (Et) and in which a high voltage is formed between them. But the output terminals (T5, T6) of the starter (Ue) can be connected between the anode (E2) of the discharge lamp (Ld) and the starting electrode (Et) and a high voltage can be applied between them. The reason for this is the following:

The high voltage which forms on the output terminals (T5, T6) of the starter (Ue) is a few kilovolts to 20 kilovolts, while the no-load voltage which has been applied during starting by the feed circuit (Ub) between the cathode (E1) and the anode (E2) of the discharge lamp (Ld) is for example roughly 200 volts to 300 volts to 1 kilovolt. In each of the terminals therefore a high voltage forms both between the starting electrode (Et) and the cathode (E1) and also between the starting electrode (Et) and the anode (E2) and also between the first outer electrode (Eu) and the second outer electrode (Ev) of the auxiliary light source (Lx). Therefore a dielectric barrier discharge forms both between the inside of the main discharge vessel (Bd) and the cathode (E1) and also between the inside of the main discharge vessel (Bd) and the anode (E2) and furthermore in the auxiliary discharge space (Zx) of the auxiliary light source (Lx).

Furthermore, entirely for the same reason the two polarities of the high voltage which forms on the output terminals (T5, T6) of the starter (Ue), i.e. both a positive high voltage and also a negative high voltage, can be used. Normally there are many cases in which it is senseless to distinguish the polarity because the high voltage which forms on the output terminals (T5, T6) of the starter (Ue) fluctuates.

FIG. 7 shows a feed circuit (Ub) of the voltage reduction chopper type by way of example. But, of course, another type of circuit can also be used, for example a voltage raising chopper, an inverting chopper, or the like. A type of starter (Ue) was shown by way of example, by which a pulsed high voltage is produced. Likewise, a type can also be used by which a direct current high voltage is produced.

Figure 8:
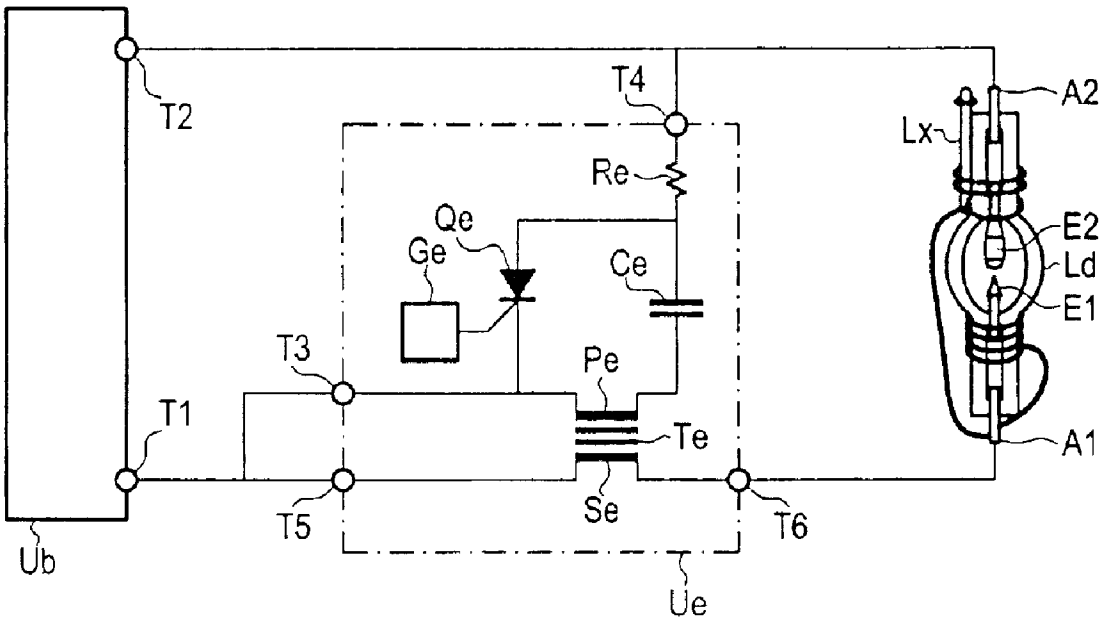
FIG. 8 shows, in a simplified representation, a schematic of another example of the operating situation of a discharge lamp of the inside trigger type of the invention using a feed device of the direct current operating type.

FIG. 8 shows an example of the situation in a simplified representation in which the discharge lamp of the inside trigger type of the invention is operated using a feed device of the direct current operating type. FIG. 8 shows a state by way of example in which the discharge lamp (Ld) shown in FIGS. 6(*a*) and(b) is connected. Since the same feed circuit (Ub) as in FIG. 7 can be used, the inside arrangement is not shown.

As the starter (Ue), one with the same arrangement as in FIG. 7 is also shown by way of example. But since its output terminals (T5, T6) are connected such that they are located between the output terminal (T1) of the feed circuit (Ub) and the outer lead (A1) of the cathode side of the discharge lamp (Ld), in operation of the starter (Ue) a high voltage is applied between the electrodes (E1, E2) as the two poles for the main discharge and moreover the first outer electrode (Eu) and the outer lead (A1) of the cathode side are electrically connected. Furthermore, the second outer electrode (Ev) and the outer lead (A2) of the anode side are electrically connected. In the auxiliary discharge space (Zx) in the auxiliary discharge vessel (Bx) therefore a dielectric barrier discharge forms. Furthermore, between the inside of the main discharge vessel (Bd) and the anode (E2) a high voltage is applied, by which a dielectric barrier discharge forms.

The light emitted in this way from the auxiliary light source (Lx) due to ionization of the discharge medium for the main discharge also promotes the formation of the dielectric barrier discharge between the inside of the main discharge vessel (Bd) and the anode (E2), at the same time promotes the formation of a discharge in the gap between the electrodes (E1, E2) for the main discharge and as a result thereof can reduce the absolute value of the high voltage which is to be applied to the conductive wire (Wt).

Figure 9C:
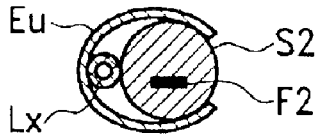
FIGS. 9(*a*) to 9(*c*) each show, in a simplified representation, a schematic of another example of the arrangement of a discharge lamp (Ld) of the outside trigger type of the invention, FIG. 9(*a*) showing the outside view, FIG. 9(*b*) showing the cross section and FIG. 9(*c*) showing a cross section through a surface which is perpendicular to the electrode axis.
Figure 9A:
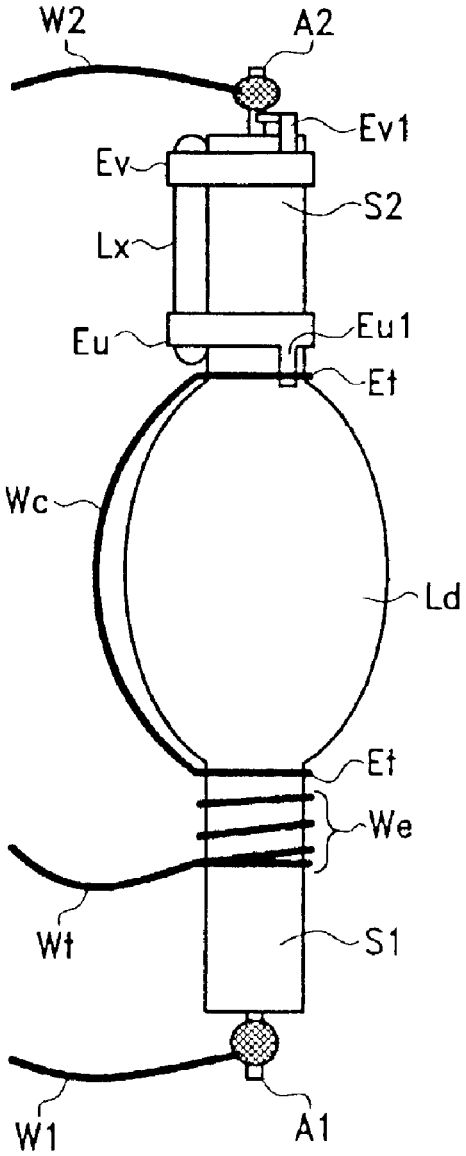
Figure 9B:
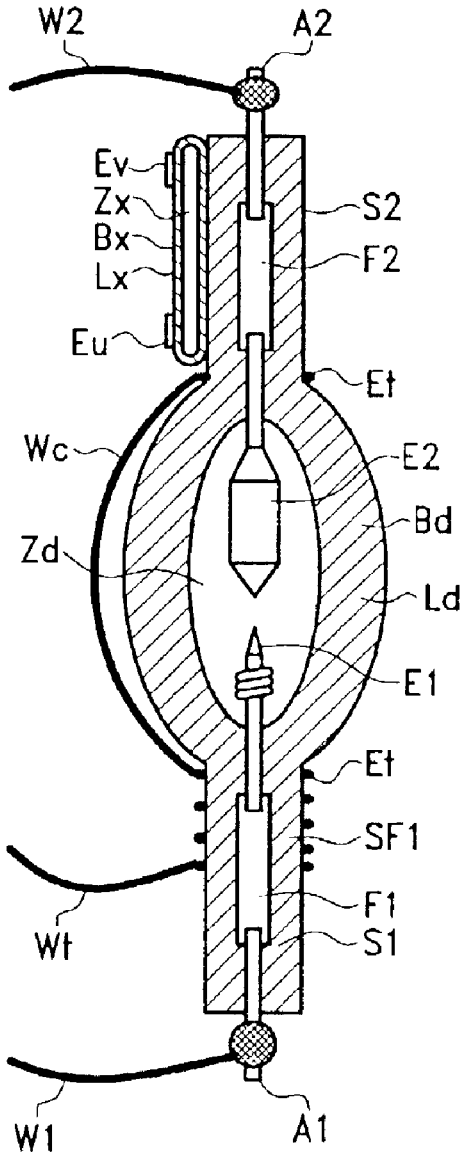

FIGS. 9(*a*) to 9(*c*) each show another example of the arrangement of a discharge lamp (Ld) of the outside trigger type of the invention. FIG. 9(*a*) shows the outside view, FIG. 9(*b*) shows the cross section and FIG. 9(*c*) shows another cross section through a surface which is perpendicular to the electrode axis.

In the discharge lamp (Ld) in these representations, the auxiliary light source (Lx) is located on the electrode sealing part (S2) on the anode side. The first outer electrode (Eu) and the second outer electrode (Ev) are formed from metal strips which also have an arrangement which is used for installation of the auxiliary light source (Lx) on the electrode sealing part (S2) on the anode side. These metal strips are held in the state in which the auxiliary light source (Lx) and the electrode sealing part (S2) on the anode side are located directly adjoining one another by spring force.

Here, an embodiment is shown, in which the metal strip which forms the first outer electrode (Eu) is provided with a projection (Eu1) and in which by winding the starting electrode (Et) from a conductive wire around this projection (Eu1) such that it comes into contact with it, electrical connection of the first outer electrode (Eu) to the starting electrode (Et) is easily carried out.

Furthermore, this embodiment shows the metal strip which forms the second outer electrode (Ev) is provided with a projection (Ev1) and in which by folding the projection (Ev1) onto the side of the outer lead (A2) toward the anode side the projection (Ev1) when attached to the discharge lamp (Ld) comes into contact with the outer lead (A2) and in which thus electrical connection of the second outer electrode (Ev) to the outer lead (A2) of the anode is easily carried out.

In these figures, using the extension part of the conductive wire comprising the starting electrode (Et) a coil-like conductive wire (We) is wound in such a way that it surrounds the hermetically sealed area (SF1) on the cathode side of the electrode sealing part (S1) of the cathode side. The outer lead (A1) on the cathode side and the conductive wire (Wt) are therefore electrically connected to one another, as was described above using FIG. 7, by the secondary winding (Se) of the high voltage transformer (Te) of the starter (Ue). During the interval during which essentially the main discharge of the discharge lamp forms, the high voltage transformer (Te) is turned off. Since, no voltage forms in its secondary winding (Se), the coil-like conductive wire (We) which is connected to the conductive wire (Wt) acts as a cathode conductor with the same electrical potential.

Another major advantage of the discharge lamp described above is illustrated by FIGS. 3(*a*) & 3(*b*):

Since using the extension part of the conductive wire comprising the starting electrode (Et) the first outer electrode (Eu) is formed by both the electrode sealing part (S1) on the cathode side on which the auxiliary discharge vessel (Bx) is located, especially the hermetically sealed area (SF1) on the cathode side, and also the auxiliary discharge vessel (Bx) being wound with conductive wire, as was described above using FIG. 7, by the secondary winding (Se) of the high voltage transformer (Te) of the starter (Ue) the outer lead (A1) on the cathode side and the conductive wire (Wt) are electrically connected to one another. During the interval during which essentially the main discharge of the discharge lamp forms, the high voltage transformer (Te) is turned off. Since, in its secondary winding (Se) no voltage forms, the first outer electrode (Eu) which is connected to the conductive wire (Wt) acts as a cathode conductor with the same electrical potential.

Figure 10A:
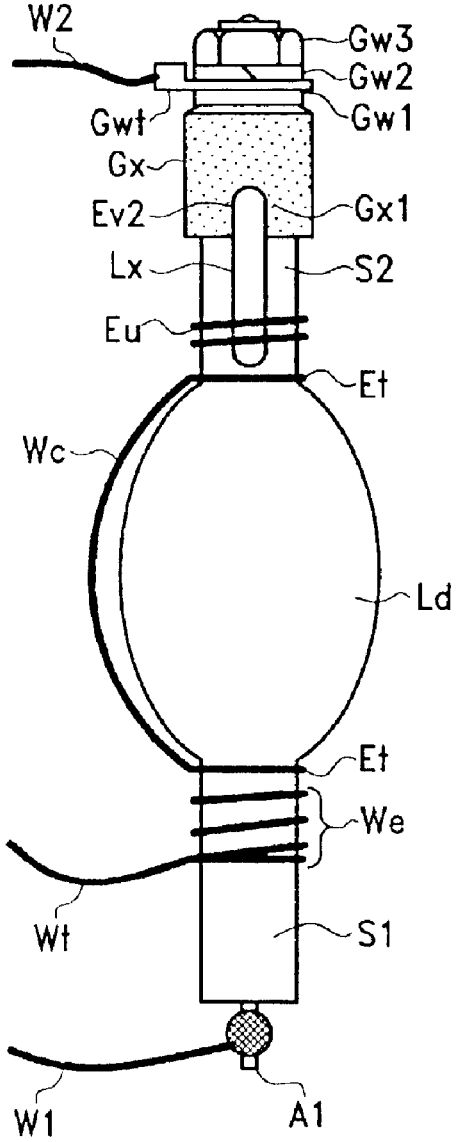
FIGS. 10(*a*) to 10(*b*) each show, in a simplified representation, a schematic of still another example of the arrangement of a discharge lamp (Ld) of the outside trigger type of the invention, FIG. 10(*a*) showing the outside view, and FIG. 10(*b*) showing the cross section perpendicular to the page of the drawing as shown in FIG. 10(*a*)
Figure 10B:
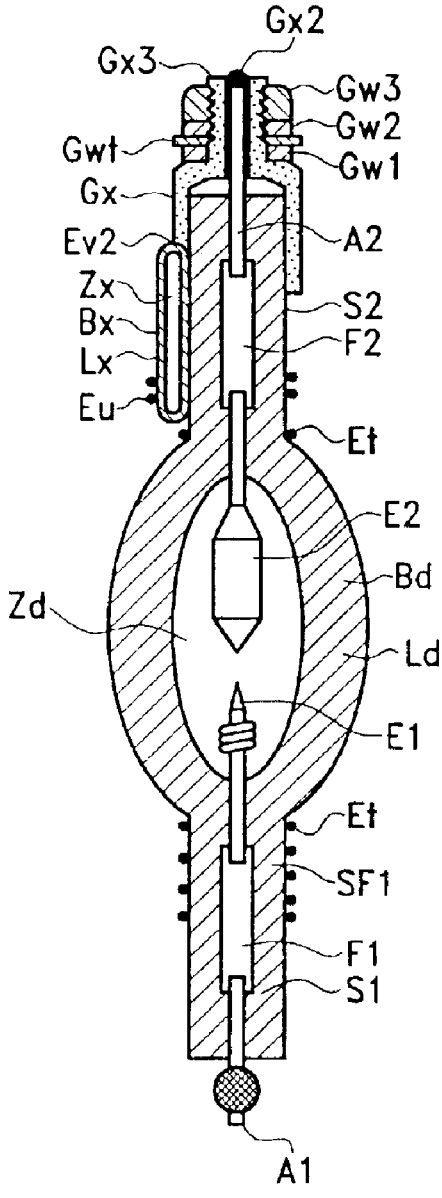

FIGS. 10(*a*) & 10(*b*) each show another embodiment of a discharge lamp (Ld) of the outside trigger type of the invention. FIG. 10(*a*) shows the outside view, and FIG. 10(*b*) shows the cross section perpendicular to the page of the drawing as shown in FIG. 10(*a*).

In the discharge lamp (Ld) in these figures, with respect to the electrode sealing part (S2), on the anode side, a base (Gx) is located, for example, using cement or the like. In this way, for example, with respect to the reflector (Y1) described above using FIG. 5 on the side on which the base (Gx) is located there can be an attachment part (Y5) of cement or the like so that it attaches the discharge lamp (Ld) in a suitable manner. To improve the property of connection to the attachment part (Y5), it is advantageous to subject the side area (Gx1) of the base (Gx) to rough surface working.

FIGS. 10(*a*) & 10(*b*) each show a situation in which the base (Gx) and the outer lead (A2) of the anode are electrically connected to one another by placing a weld part (Gx2) or the like on one end of the base (Gx), and in which a terminal (Gwt) to which a conductive wire (W2) is connected is electrically connected using a nut (Gw3) together with washers (Gw1, Gw2) and is attached in a threaded spindle (Gx3) which is located in the base (Gx).

The auxiliary light source (Lx) is located on the electrode sealing part (S2) on the anode side. In the base (Gx) there is a gap (Ev2) with a U-shape or the like, in which the auxiliary discharge vessel (Bx) of the auxiliary light source (Lx) is located such that it is located adjacent. The base (Gx) functions as the second outer electrode (Ev) of the auxiliary light source (Lx) by this arrangement.

On the other hand, the first outer electrode (Eu) of the auxiliary light source (Lx) is formed by both the electrode sealing part (S2) in which the auxiliary discharge vessel (Bx) is located and also the auxiliary discharge vessel (Bx) being wound with a conductive wire using the extension part of the conductive wire comprising the starting electrode (Et).

In these figures, as in FIGS. 9(*a*) to 9(*c*), using the extension part of the conductive wire comprising the starting electrode (Et) a coil-like conductive wire (We) is wound in such a way that the hermetically sealed area (SF1) is surrounded on the cathode side of the electrode sealing part (S1) of the cathode side. Thus it acts as a cathode conductor with the same electrical potential.

The invention was described above mainly for the use in direct current operation. But the invention also has entirely the same function in the case of alternating current operation. In a discharge lamp for direct current operation, with respect to the electrodes as the two poles for the main discharge there is differentiation between the cathode and the anode. In a discharge lamp of the alternating current type, there is an embodiment in which the arrangement of the main part of the discharge lamp has a difference from the discharge lamp for the direct current type of operation, that due to the flexible relation between the cathode and anode for example the electrodes have the same arrangement. This difference however has essentially no connection to the action and effect of the invention.

Figure 11:
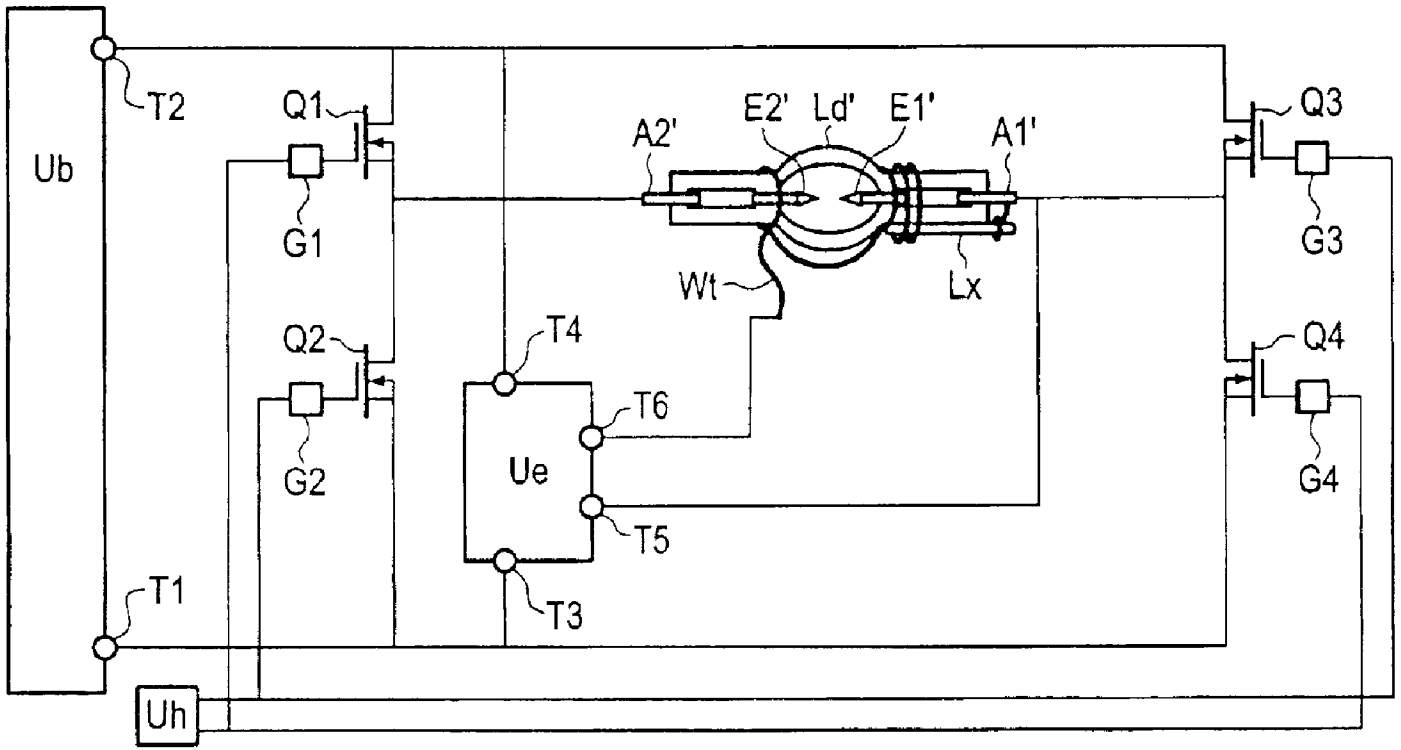
FIG. 11 shows, in a simplified representation, a schematic of one example of the operating situation of a discharge lamp of the outside trigger type of the invention using a feed device of the alternating current operating type.

FIG. 11 shows an example of the situation in which a discharge lamp of the outside trigger type of the invention is operated using a feed device of the alternating current operating type. FIG. 11 describes by way of example the state in which the same discharge lamp as in FIGS. 3(*a*) & 3(*b*) is connected as the discharge lamp (Ld'). But since this lamp is driven using an alternating current, only the electrodes (E1', E2') for the main discharge with a form different from the electrodes (E1, E2) of the lamp which is shown in FIGS. 3(*a*) & 3(*b*) are shown.

FIG. 11 shows, by way of example, a circuit in which a full bridge inverter of switching devices (Q1, Q2, Q3, Q4) such as a FET or the like is added to the above described circuit which is shown in FIG. 7 so that it is possible to apply an alternating discharge voltage to the discharge lamp (Ld'). The switching devices (Q1, Q2, Q3, Q4) are each driven by gate driver circuits (G1, G2, G3, G4) which are controlled by a full bridge inverter control circuit (Uh) such that the switching devices (Q1, Q4) and switching devices (Q2, Q3) which are each the diagonal elements of the full bridge inverter are closed at the same time.

In FIG. 11, the starter (Ue) is identical to the starter (Ue) which is shown above using FIG. 7. But in FIG. 11 the output terminal (T5) which corresponds to one end of the secondary winding is connected directly to the outer lead (A1') of the electrode (E1') of the discharge lamp (Ld'), while in FIG. 7 it is connected to the output terminal (T1) of the feed circuit (Ub). In this way the difference is eliminated by the addition of the full bridge inverter of switching devices (Q1, Q2, Q3, Q4).

The output terminal (T5) of the starter (Ue) is therefore connected in entirely the same way as described above using FIG. 7 to the one electrode (E1') of the discharge lamp (Ld') and to the second outer electrode of the auxiliary light source (Lx). Furthermore, the output terminal (T6) of the starter (Ue) is connected via the conductive wire (Wt) to the starting electrode which is located outside the main discharge vessel of the discharge lamp (Ld') and to the first outer electrode of the auxiliary light source (Lx). In the auxiliary discharge space of the auxiliary light source (Lx) therefore a dielectric barrier discharge is formed by the high voltage which has formed on the output terminals (T5, T6) of the starter (Ue). Furthermore, between the electrodes (E1', E2') for the main discharge of the discharge lamp (Ld') and the inside of the main discharge vessel of the discharge lamp (Ld') a dielectric barrier discharge forms.

If it is possible for the timing of the switching of the closed states of the switching devices (Q1, Q2, Q3, Q4) of the full bridge inverter and the formation of the high voltage of the starter (Ue) to be unfavorable with respect to discharge starting of the lamp, this disadvantage with respect to timing with regard to discharge starting of the lamp can be avoided either by synchronization such that the timing of the switching of the closed states of the switching devices (Q1, Q2, Q3, Q4) and the formation of the high voltage of the starter (Ue) becomes correct, or by stopping operation of the full bridge inverter until completion of discharge starting of the lamp.

Figure 12:
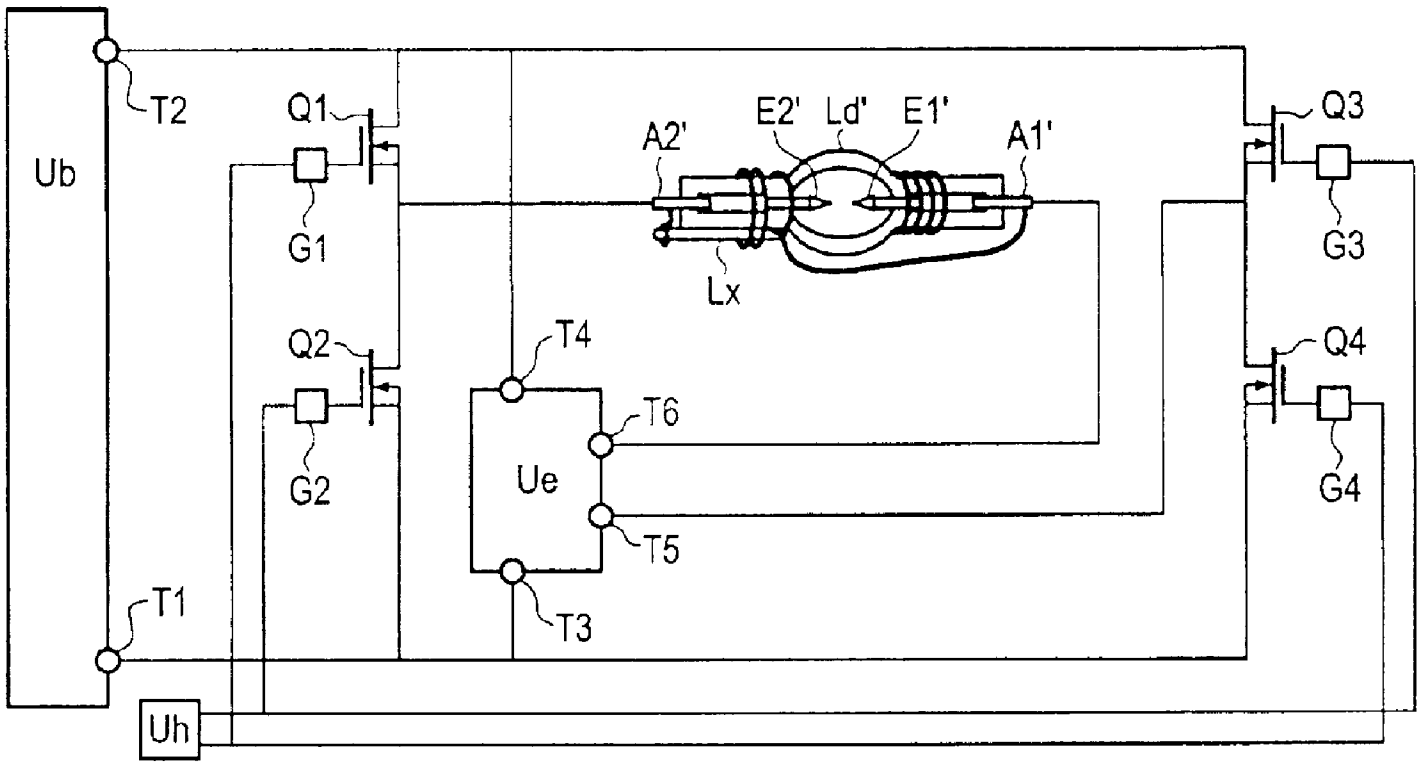
FIG. 12 shows, in a simplified representation, a schematic of another example of the operating situation of a discharge lamp of the inside trigger type of the invention using a feed device of the direct current operating type.

FIG. 12 shows still another embodiment in which a discharge lamp of the inside trigger type of the invention is operated using a feed device of the alternating current operating type. FIG. 12 describes by way of example the state in which the same discharge lamp as in FIG. 6(*a*) & 6(*b*) is connected as the discharge lamp (Ld'). But since this lamp is driven using an alternating current, only the electrodes (E1', E2') for the main discharge are shown which have a form different from the electrodes (E1, E2) of the lamp which is shown in FIGS. 6(*a*) & 6(*b*). Since furthermore the lamp is driven using an alternating current, the conductive wire (We) as the cathode conductor with the same electrical potential which is effective in a lamp of the direct current driving type is not shown here.

Since the output terminals (T5, T6) of the starter (Ue) are connected in such a way that they are located between the output terminal (Ti) of the feed circuit (Ub) and the outer lead (A1') of the discharge lamp (Ld'), during operation of the starter (Ue) between the electrodes (E1', E2') of the two poles for the main discharge a high voltage is applied and moreover the first outer electrode of the auxiliary light source (Lx) and one outer lead (A1') are electrically connected. Furthermore, the second outer electrode of the auxiliary light source (Lx) and the other outer lead (A2') are electrically connected. In the auxiliary discharge space of the auxiliary discharge vessel therefore a dielectric barrier discharge forms. Furthermore, between the inside of the main discharge vessel and the electrode (E2') a high voltage is also applied, producing a dielectric barrier discharge.

The invention according to its first embodiment in the implementation of a discharge lamp with an auxiliary light source for reducing the absolute value of the high voltage which is to be applied during starting makes it possible to avoid the disadvantage of a complicated arrangement and the resulting increase of costs, to reduce the disadvantage of obtaining faulty products and to eliminate the reduction of the reliability of the finished part.

The invention also yields the effects that the number of high voltage generating parts for the feed device can be reduced, as can the costs of the light source device. While, still another advantage of the invention is that the dielectric barrier discharge in the auxiliary discharge space (Zx) can be produced at a lower voltage or the amount of emission from the auxiliary discharge space can be increased and that moreover operation of the auxiliary light source (Lx) can be stabilized.

Another advantage of the invention is that the outer electrode of the auxiliary light source (Lx) can be formed by a simple arrangement, that the electrical connection is carried out with certainty and that attachment of the auxiliary light source (Lx) can be done with low costs. While another advantage of the invention is that the number of cables for electrical connection of the discharge lamp to the feed device can be reduced, and another advantage of the invention is that the degree of light utilization can be increased and a discharge lamp with high efficiency can be implemented.

What is claimed is:

1. Discharge lamp including a main discharge vessel having a discharge space filled with a discharge medium for a main discharge, a pair of opposed electrodes for the main discharge, a first electrode sealing part and a second electrode sealing part for the pair of main discharge electrodes, comprising a starting electrode in addition to the main discharge electrodes arranged such that the starting electrode does not come into contact with the main discharge space, an auxiliary light source which comprises an auxiliary discharge vessel located adjacent to and on a side of at least one of the electrode sealing parts, which is not made integral with the electrode sealing parts, and which is filled with a discharge medium for the auxiliary discharge, and a first outer electrode for the auxiliary light source located on the outside of the auxiliary discharge vessel; and wherein the starting electrode is located at positions for assisting the main discharge.

2. Discharge lamp as claimed in claim 1, wherein the starting electrode and the first outer electrode are electrically connected to one another.

3. Discharge lamp as claimed in claim 1, wherein the main discharge electrode located at the end of the main discharge vessel on which the auxiliary light source is not located, and the starting electrode are electrically connected to one another.

4. Discharge lamp as claimed in claim 1, wherein the main discharge vessel and the electrode sealing parts have an essentially symmetrical arrangement with respect to a middle axis and the distance between the part of the auxiliary discharge vessel farthest away from the middle axis and the middle axis does not exceed a radius of the thickest area of the outside shape of the main discharge vessel.

5. Discharge lamp as claimed in claim 1, wherein said positions are in the vicinity of boundary areas between the main discharge vessel and the electrode sealing parts.

6. Discharge lamp as claimed in claim 1, wherein, for starting of the discharge lamp, a high no-load voltage is applied between the electrodes for the main discharge, and at the same time, a high voltage is also applied by the starting electrode between the inside of the main discharge vessel and an anode of the electrodes for the main discharge, by which a dielectric barrier discharge is formed, ionization of the discharge medium is promoted and an insulation breakdown induced between the electrodes for the main discharge.

7. Discharge lamp including a main discharge vessel having a discharge space filled with a discharge medium for a main discharge, a pair of opposed electrodes for the main discharge, a first electrode sealing part and a second electrode sealing part for the pair of main discharge electrodes, comprising a starting electrode in addition to the main discharge electrodes arranged such that the starting electrode does not come into contact with the main discharge space, an auxiliary light source which comprises an auxiliary discharge vessel located adjacent to and on a side of at least one of the electrode sealing parts, which is not made integral with the electrode sealing parts, and which is filled with a discharge medium for the auxiliary discharge, and a first outer electrode for the auxiliary light source located on the outside of the auxiliary main discharge vessel;

wherein the auxiliary light source located on the outside of the main discharge vessel is provided with a second electrode; and wherein the second electrode and the main discharge electrode are electrically connected to each other at an end of the discharge vessel at which the auxiliary light source is located.

8. Discharge lamp including a main discharge vessel having a discharge space filled with a discharge medium for a main discharge, a pair of opposed electrodes for the main discharge, a first electrode sealing part and a second electrode scaling part for the pair of main discharge electrodes, comprising a starting electrode in addition to the main discharge electrodes arranged such that the starting electrode does not come into contact with the main discharge space, an auxiliary light source which comprises an auxiliary discharge vessel located adjacent to and on a side of at least one of the electrode sealing parts, which is not made integral with the electrode sealing parts, and which is filled with a discharge medium for the auxiliary discharge, and a first outer electrode for the auxiliary light source located on the outside of the auxiliary discharge vessel;

wherein the first outer electrode is a conductive wire wound around the electrode sealing part on which the auxiliary discharge vessel is located and the auxiliary discharge vessel.

* * * * *